US006169495B1

(12) United States Patent
Koike

(10) Patent No.: US 6,169,495 B1
(45) Date of Patent: Jan. 2, 2001

(54) VEHICLE TRAFFIC CONTROL SYSTEM

(75) Inventor: Shin Koike, Aichi-ken (JP)

(73) Assignee: Toyota Jidosha Kabushiki Kaisha, Toyota (JP)

( * ) Notice: Under 35 U.S.C. 154(b), the term of this patent shall be extended for 0 days.

(21) Appl. No.: 09/159,781

(22) Filed: Sep. 24, 1998

(30) Foreign Application Priority Data

Oct. 23, 1997 (JP) ..... 9-290753

(51) Int. Cl.[7] ..... G08G 1/095

(52) U.S. Cl. ..... 340/909; 340/435; 340/436; 340/903; 340/905; 701/301

(58) Field of Search ..... 340/903, 436, 340/435, 905; 701/301, 300, 23, 24, 27, 200, 213, 214, 93, 98

(56) References Cited

U.S. PATENT DOCUMENTS

| | | | |
|---|---|---|---|
| 3,895,584 | 7/1975 | Paddison | 104/88.03 |
| 4,350,970 | 9/1982 | Von Tomkewitsch | 340/989 |
| 5,428,544 | 6/1995 | Shyu | 701/117 |
| 5,604,676 | 2/1997 | Penzias | 705/417 |
| 5,623,413 | 4/1997 | Mateson et al. | 701/117 |
| 5,781,119 * | 7/1998 | Yamashita et al. | 340/903 |
| 5,983,161 * | 11/1999 | Lemelson et al. | 701/301 |

FOREIGN PATENT DOCUMENTS

| | | |
|---|---|---|
| 19726542 | 11/1998 | (DE) . |
| 618523 | 10/1994 | (EP) . |
| 62-125407 | 6/1987 | (JP) . |
| WO 94/05536 | 3/1994 | (WO) . |

* cited by examiner

*Primary Examiner*—Daryl Pope
(74) *Attorney, Agent, or Firm*—Pillsbury Madison & Sutro LLP

(57) ABSTRACT

A vehicle traffic control system that does not cause course conflicts at intersections. A present position, speed, and destination of each vehicle are collected, vectors are generated to indicate possible courses for each vehicle on the basis of the collected information, and vectors indicating courses of each vehicle are combined to generate matrices. Only matrices where a plurality of vehicles do not approach an identical intersection at or around the same time, or even if such a situation occurs, only matrices where a course of a certain vehicle does not cross a course of another vehicle at that intersection, are employed. Of the employed matrixes, one is selected indicating a course set in which an average time required for each vehicle to reach a destinations is shortest.

18 Claims, 24 Drawing Sheets

VEHICLE TRAFFIC CONTROL SYSTEM

BACKGROUND OF THE INVENTION

1. Field of the Invention

The present invention relates to a vehicle traffic control system for controlling traffic of a plurality of vehicles.

2. Description of the Related Art

A Vehicle Information and Communications System (VICS) is presently implemented in Japan and is a system for transmitting information regarding road congestion and traffic restrictions to vehicles on roads through roadside beacons and FM multiplexed data broadcasts. One advantage of this system as seen from road traffic control is that the operator of each vehicle can be prompted through radio communications to detour congested roads and to use less congested roads so that traffic congestion can be alleviated to a certain extent. As seen from the operator of each vehicle, an advantage is that when there are a plurality of courses from present position to destination, relatively empty roads can be selected, the result being the destination can be reached quickly and comfortably. However, since VICS entrusts the determination of the course of each vehicle to the intentions of the operator of each vehicle, there are individual limits to the advantages of alleviating congestion and of increasing the speed and comfort of vehicle operation.

The manner in which vehicles are allowed to smoothly cross intersections is one problem that develops when enhancing the advantages of alleviating congestion and of increasing the speed and comfort of vehicle operation. As a technique concerning this point, a traffic control method is disclosed in Japanese Patent Laid-Open Publication No. Sho 62-125407. This traffic control method applies to systems comprising a plurality of driver-less vehicles to be controlled and a control station for controlling these driver-less vehicles. When a plurality of driver-less vehicles approach an identical intersection at or around the same time in this system, the control station grants permission to one of the driver-less vehicles to enter the intersection and causes the other driver-less vehicles to wait, and after the driver-less vehicle that has obtained permission has crossed the intersection, one of the other driver-less vehicles that is waiting is granted permission to enter the intersection. In this manner, a plurality of driver-less vehicles approaching an identical intersection at or around the same time are allowed to cross the intersection in turn so as to prevent the driver-less vehicles from colliding or contacting each other at the intersection. This traffic control method can also be combined with VICS.

However, for the following reasons, a system obtained by combining the traffic control method disclosed in the above-mentioned publication with VICS is not suitable for applications in which a large number of vehicles are to be controlled.

Firstly, the traffic control method concerned with in the above-mentioned publication applies to systems in which a relatively small number of vehicles travel, such as in a factory. Since the number of vehicles approaching an identical intersection at or around the same time is relatively small in this type of system, there is no substantial delay in reaching destinations even if entry permission and wait control are performed at the intersection. In contrast, in an environment where a large number of vehicles frequently are located on roads such as in ordinary road traffic, the number of vehicles approaching an identical intersection at or around the same time may be high. In the system concerning the above-mentioned combination, namely, a system in which one vehicle crosses an intersection at a time when a plurality of vehicles approach that intersection at or around the same time, the waiting time at the intersection for most of the vehicles becomes long when there are many vehicles approaching the intersection, and results in delays in reaching destinations.

Secondly, the traffic control method concerned with in the above-mentioned publication controls driver-less vehicles so that passengers do not become impatient since there are no passengers. In contrast, in an environment where vehicles carrying passengers travel, such as in ordinary road traffic, there are likely to be passengers who become impatient when vehicles are forced to wait at intersections. In the system concerning the above-mentioned combination, particularly when many vehicles approach an identical intersection at or around the same time, passengers are liable to become impatient as the waiting time at the intersection lengthens. Furthermore, when traveling a course having many intersections, a vehicle may have to wait at many (or often at all) the intersections so that the passengers are liable to become impatient.

Thirdly, on ordinary roads, there are usually many intersections along a course from present position to destination. Furthermore, in the case of a gasoline-powered vehicle, it is known that repetitive stopping and starting, and acceleration and deceleration, and in turn the frequent fluctuations in engine revolutions result in poor energy efficiency for the vehicle and increased gas emissions from the vehicle. In the system concerning the above-mentioned combination, it is possible for the energy efficiency of each vehicle to deteriorate and for the gas emissions from each vehicle to increase since the vehicles may have to wait at many intersections along the courses.

Fourthly, in the system concerning the above-mentioned combination, the entry into intersections is controlled, while other non-intersection locations are not subject to control, and relevant information, such as extent of congestion, is only provided to the operator of the vehicle. Therefore, there is possibility for congestion to occur at non-intersection locations, such as along roads connecting intersections to each other. Although the operator of the vehicle can be informed as to which roads are congested and which roads are not, the operator is not informed of which roads to travel to reach the destination in the fastest time. Thus, the system concerning the above-mentioned combination does not sufficiently assist the vehicle passenger in terms of quickly reaching the destination.

SUMMARY OF THE INVENTION

The present invention is intended to solve these problems and has an object to eliminate waiting at intersections, repetitive stopping and starting, and in turn eliminate the delays in reaching destinations and the deterioration of energy efficiency and gas emissions by controlling (includes indirect control by informing passengers) the course of each vehicle so that conflicts among courses of vehicles can be avoided at intersections, and by controlling the start time of each vehicle. The present invention further has an object to enable the amount of traffic to increase while maintaining good energy efficiency and to enable the start time of each vehicle to be shortened by eliminating conflicts at intersections and introducing control suited to the amount of traffic and the start times.

The first aspect of the present invention is a vehicle traffic control system covering a predetermined area, while the second aspect of the invention is a vehicle traffic control method implemented in the area. The area has a plurality of roads and/or tracks that intersect at various locations, and a plurality of vehicles in general travel along the roads and/or tracks. In the present invention, course sets, each of which is a combination of one vehicle's possible course and other vehicles' possible courses which may be taken in the future in the above-mentioned area, are generated. Next, the generated course sets are determined as possible course patterns. In the first aspect of the present invention, a possible course determination apparatus performs the above-mentioned course set generating process and possible course pattern determination process.

In the present invention, among the possible course patterns, possible course patterns with less conflict are selected. The 'conflict' mentioned here can be defined as a phenomenon where one vehicle's course crosses another vehicle's course at an identical intersection at or around the same time. Finally, one of selected possible course patterns is selected as a course pattern. The course pattern mentioned here is a command to the vehicles or vehicle operators, and indicates a set of courses to be taken by the vehicles located within the above-mentioned area, to avoid the conflict. In the first aspect of the invention, these two process are performed by a course determination apparatus.

In this manner, waiting at intersections, repetitive stopping and starting, and in turn delays in reaching destinations and the deterioration of energy efficiency and gas emissions do not occur in the present invention since the future course of each vehicle is determined so that conflicts at intersections do not occur.

In a preferred embodiment of the present invention, an average expected time discriminator is further provided. When there are many possible course patterns in which course conflicts do not occur, the average expected time discriminator calculates the average expected time for each vehicle to reach the respective destination, for each possible course pattern, and selects the possible course pattern having a relatively small average expected time so as to determine a course pattern indicating a set of courses to be taken by respective vehicles within the area. In this manner, it is further possible to avoid delays in reaching destinations by determining the course pattern in which conflicts do not occur and in which almost all of the vehicles reach their destinations quickly.

In a preferred embodiment of the present invention, a start time determination apparatus is further provided. The start time determination apparatus determines a time until start for a presently waiting vehicle-under-control. The vehicle-under-control mentioned here is a vehicle located within the area and yielding to a determined course pattern. The start time determination apparatus performs this calculation for possible course patterns in which course conflicts do not occur for any vehicle or at any intersection. By using the time-until-start obtained in this manner, to control the vehicles' operation, waiting at intersections and repetitive stops and starts, and in turn delays in reaching destinations and deterioration of energy efficiency and gas emissions are reduced.

The third aspect of the present invention is a vehicle traffic control system having a position detection apparatus, a destination detection apparatus, and a course calculation apparatus, in addition to the possible course determination apparatus and the course determination apparatus. The position detection apparatus detects present positions of vehicles including a vehicle-under-control, using devices installed on the vehicles or provided outside the vehicles. The destination detection apparatus detects destinations for vehicles including the vehicle-under-control, through input by passengers of the vehicles, or through estimation based on movements of the vehicles. The course calculation apparatus determines the courses of vehicles including the vehicle-under-control, on the basis of the detected present positions and destinations, and the speeds to be adopted on respective roads and/or tracks. The possible course determination apparatus generates the above-mentioned course sets, on the basis of the courses determined by the course calculation apparatus.

According to this aspect, since the course to be taken by each vehicle is determined from the vehicles' present positions, destinations, and speed to be adopted, devising a method to furnish the present positions, destinations, and speeds to be adopted yields an additional advantage. For example, processes are possible for allocating the speeds to be adopted on respective roads and/or tracks so that a relatively high speed is assigned to a road or a track for which traffic is predicted to be relatively heavy when respective vehicles in said area move according to the course pattern, for allocating the speeds to be adopted on respective roads and/or tracks so that a relatively high speed is assigned to a road or a track for which it is predicted that vehicles having relatively long start times pass in relatively high numbers when respective vehicles in said area move according to the course pattern, and for allocating the speeds to be adopted on respective roads and/or tracks so that the speeds are uniformly increased in accordance with increasing a predicted average start time for vehicles waiting to start, calculated under the assumption that respective vehicles in the area move according to the course pattern. These processes yield effects where the amount of traffic in the overall area is increased, the wait times until start are shortened while the amount of traffic in the overall area is increased, and the wait times until start can be shortened so that a large number of vehicles need not wait to start, respectively. Furthermore, if the present position is detected and the destination is estimated for a vehicle-out-of-control, the result can be reflected on determining the course pattern and thus the determination of the course pattern can be made precise and optimized through the estimation of the destination for the vehicle-out-of-control.

The fourth aspect of the present invention is a vehicle traffic control system having the position detection apparatus, the destination detection apparatus, the course calculation apparatus, the possible course determination apparatus and the course determination apparatus. In this aspect of the invention, a vehicle—vehicle communication channel for connecting vehicles-under-control to each other is provided and each of the vehicles-under-control has a combination apparatus of the position detection apparatus, the destination detection apparatus, the course calculation apparatus, the possible course determination apparatus and the course determination apparatus. Each of the vehicles-under-control receives information from other vehicles-under-control via the vehicle—vehicle communication channel, operates the combination apparatus on the basis of the information from other vehicles-under-control, and transmits information obtained in processing by the combination apparatus to other vehicles-under-control via the vehicle—vehicle communication channel. For instance, the detected present position and destination or the component, of the course pattern, indicating the receiving vehicle's course are transmitted and received by the vehicles-under-control.

The fifth aspect of the invention is a vehicle apparatus installed in a vehicle and used in a vehicle traffic control system. According to this aspect, the vehicle apparatus has the position detection apparatus, the destination detection apparatus, the course calculation apparatus, the possible course determination apparatus, the course determination apparatus. In particular, the position detection apparatus and destination detection apparatus receive information from other vehicles-under-control via the vehicle—vehicle communication channel, and derive the present positions and destinations of at least some of the vehicles located within the area based on the information from the other vehicles-under-control. Thus, the course determination apparatus can determine the course pattern or its necessary component (a component indicating a course to be taken by the vehicle carrying the vehicle apparatus).

If the present invention is implemented in this manner through vehicle—vehicle communications, it is not necessary to provide a control station and thus infrastructure costs are not generated. Furthermore, the processing in each vehicle can use the determined courses of other vehicles so that processing requirements remain low. Moreover, the information to be transferred between vehicles is only a small amount, which is the part relating to the course of the individual vehicle among the present position, destination, and determined course pattern, so that congestion of the vehicle—vehicle radio channel is unlikely to occur.

The sixth aspect of the invention is a vehicle traffic control system having a controller-vehicle communication channel for connecting a control station covering the area and vehicles-under-control. In this aspect of the invention, a combination apparatus of the position detection apparatus, the destination detection apparatus, the course calculation apparatus, the possible course determination apparatus and the course determination apparatus is divided into two partial processing apparatus. Namely, each of the vehicles-under-control has a first partial processing apparatus, while the control station has a second partial processing apparatus, and the first and second partial apparatuses are connected via the controller-vehicle communication channel. Each of the vehicles-under-control receives information such as a component indicating the course to be taken by the vehicle, from the control station via the controller-vehicle communication channel. The vehicle-under-control operates the first partial processing apparatus on the basis of the information from the control station, and transmits information, such as the present position and destination of the vehicle or the possible courses of the vehicle, obtained in processing, such as the detection of the present position and destination or the calculation of the possible courses, by the first partial processing apparatus, to the control station via said controller-vehicle communication channel. The control station receives information from the vehicles-under-control via the controller-vehicle communication channel, operates the second partial processing apparatus on the basis of the information from the vehicles-under-control, and transmits information obtained in processing by the second partial processing apparatus to the vehicles-under-control via the controller-vehicle communication channel.

The seventh aspect of the invention is a vehicle apparatus installed in a vehicle and used in a vehicle traffic control system. According to this aspect of the invention, the vehicle apparatus has the position detection apparatus, the destination detection apparatus, the course calculation apparatus, and the course determination apparatus. The course determination apparatus according to this aspect transmits the possible courses, calculated by the course calculation apparatus, to the control station covering the area via the controller-vehicle communication channel, and receives, as a course pattern or its component, information indicating the possible course pattern or component thereof with less conflict relating to the vehicle carrying the vehicle apparatus, from the control station via the controller-vehicle communication channel.

The eighth aspect of the invention is a vehicle apparatus installed in a vehicle and used in a vehicle traffic control system. According to this aspect, the vehicle apparatus has the position detection apparatus, the destination detection apparatus and the course determination apparatus. The position detection apparatus and destination detection apparatus in this aspect detect a present position of and a destination for the vehicle carrying the vehicle apparatus. The course determination apparatus according to this aspect transmits thus-detected present position and destination to the control station covering the area via the controller-vehicle communication channel, and receives, as the course pattern or its component, information indicating a possible course pattern or component thereof with less conflict relating to the vehicle carrying said vehicle apparatus, from the control station via the controller-vehicle communication channel.

The ninth embodiment of the present invention is a controller set for use as a control station in a vehicle traffic control system and controlling a plurality of vehicles in general located within an area in which a plurality of roads and/or tracks intersect at various locations. The controller set has the position detection apparatus, the destination detection apparatus and the course determination apparatus. The position detection apparatus detects present positions of vehicles, including a vehicle-under-control, using devices installed on the vehicles or provided outside the vehicles. The destination detection apparatus detects destinations of vehicles, including the vehicle-under-control, through the reception from the vehicle-under-control via the vehicle-controller communication channel, or through the estimation based on movements of the vehicles. The course determination apparatus transmits information indicating thus-detected present positions and destinations to the vehicle-under-control via the vehicle-controller communication channel. Therefore, the vehicle-under-control can determine a course pattern or its component relating to the vehicle-under-control on the basis of the information from the control station such that a course of the vehicle-under-control does not cross another vehicle's course at an identical intersection at or around the same time.

The tenth aspect of the present invention is a controller set for use as a control station in a vehicle traffic control system and controlling a plurality of vehicles in general located within an area in which a plurality of roads and/or tracks intersect at various locations. The controller set has the position detection apparatus, the destination detection apparatus, the course calculation apparatus, and the course determination apparatus. The position detection apparatus detects the present positions of the vehicles, including a vehicle-under-control, using devices installed on the vehicles or provided outside the vehicles. The destination detection apparatus detects the destinations of the vehicles, including the vehicle-under-control, through reception from the vehicle-under-control via the vehicle-controller communication channel, or through estimation based on the movements of the vehicles. The course calculation apparatus calculates the possible courses of the vehicles, including the vehicle-under-control, on the basis of the detected present positions and destinations of the vehicles and the speeds to be adopted on respective roads and/or tracks. The course determination apparatus transmits information indicating the possible courses calculated by the course calculation apparatus, to the vehicle-under-control via the vehicle-controller communication channel. Therefore, the vehicle-under-control can determine the course pattern or its component relating to the vehicle-under-control on the basis of the information from the control station such that a course of the vehicle-under-control does not cross another vehicle's course at an identical intersection at or around the same time.

If at least part of the processes is executed in this manner at the control station, the processes at each vehicle can be reduced.

In a preferred embodiment of the present invention, for example, a traffic adaptive speed allocation apparatus is provided. This apparatus allocates the above-mentioned speed such that a relatively high speed is assigned to a road or track for which traffic is predicted to be relatively heavy when each vehicle moves according to the determined course pattern. Since this enables the traffic to be increased on roads or tracks that are easily congested, the traffic in the overall area can be increased.

In a preferred embodiment of the present invention, for example, a start time adaptive individual speed allocation apparatus is provided. This apparatus allocates the above-mentioned speed such that a relatively speed is assigned to a road or track for which it is predicted that vehicles having relatively long start times pass in relatively high numbers when vehicles move according to the determined course pattern. Since this enables vehicles having long wait times to be given priority to reach their destinations, the traffic in the overall area can be increased and wait times until start can be reduced.

In a preferred embodiment of the present invention, for example, start time adaptive speed allocation apparatus is provided. This apparatus allocates the above-mentioned speed so that the speeds are uniformly increased in accordance with the predicted average start time for vehicles waiting to start, under the assumption that vehicles move according to the determined course pattern. This enables wait times until start to be reduced so that a situation where many vehicles wait to start can be avoided.

In a preferred embodiment of the present invention, the position detection apparatus and the destination detection apparatus also detect the present position and destination for vehicles-out of control. The possible course of the vehicle-out-of-control is also included in the course set. Thus, the determination of the course pattern can be precisely performed through the estimation of the destination for the vehicle that is not to be controlled.

According to a preferred embodiment of the present invention, a hand-over vehicle count apparatus is provided to input information indicating possible courses of each entering vehicle which is predicted to enter the area in the near future. The possible course determination apparatus generates the course sets on the basis of the possible courses of both the vehicle-under-control and the entering vehicle. If a controller-controller communication channel for connecting a control station covering the area and another control station covering another area is provided, the hand-over vehicle count apparatus inputs from another control station the information indicating the possible courses of each entering vehicle, and supplies to this control station the information indicating possible courses of each exiting vehicle which is predicted to exit the area, through the controller-controller communication channel.

In this manner, for example, in a traffic control system where a control station is provided in each area of a plurality of areas, it is possible for each vehicle to preferably be controlled according to the present invention regardless of the separation into a plurality of areas. In particular, the use of the controller-controller radio channel yields the above-mentioned result through a relatively simple controller-controller communications method.

In a preferred embodiment of the present invention, tracks within the area for the vehicles to be controlled to move along, and depots along the track for users to get on and off the vehicles are provided. Furthermore, at least one scheduler for controlling branching and linking operations of the tracks is provided at corresponding intersections of the tracks. A control station covering this area comprises the position detection apparatus, the destination detection apparatus, the course calculation apparatus, the possible course determination apparatus, and the course determination apparatus. These apparatuses operate according to users' request from the facilities such as request terminals provided at the depots so as to command branching and linking operations of the corresponding intersection by the scheduler according to the resulting determined course pattern.

In a preferred embodiment of the present invention, the tracks within the area for the vehicle to be controlled to move along, and the depots along the tracks for the users to get on and off the vehicles are optionally provided. The control station covering this area comprises the position detection apparatus, the destination detection apparatus, the course calculation apparatus, the possible course determination apparatus, and the course determination apparatus. These apparatuses operate according to users' request at the depots so as to control the vehicle's movement according to the resulting determined course pattern.

In this manner, the effect of the present invention can be realized even in a tracked traffic system having many intersections (branch points) and having many unspecified users.

DETAILED DESCRIPTION OF THE PREFERRED EMBODIMENTS

Preferred embodiments of the present invention will be described hereinafter with reference to the attached drawings. Common or corresponding members among the embodiments will be assigned the same reference numbers and their descriptions will not be repeated. This does not suggest, however, that members assigned with identical reference numbers must have strictly identical functions. Furthermore, although the description hereinafter deals with automobiles for traffic control, the present invention is generally applicable to vehicles traveling on roads or tracks.

Moreover, the vehicles referred to herein include living beings, such as ambulatory humans. Furthermore, the description herein uses the term "intersection" to include T-shaped intersections and branches of tracks.

(1) Principles

Figure 1:
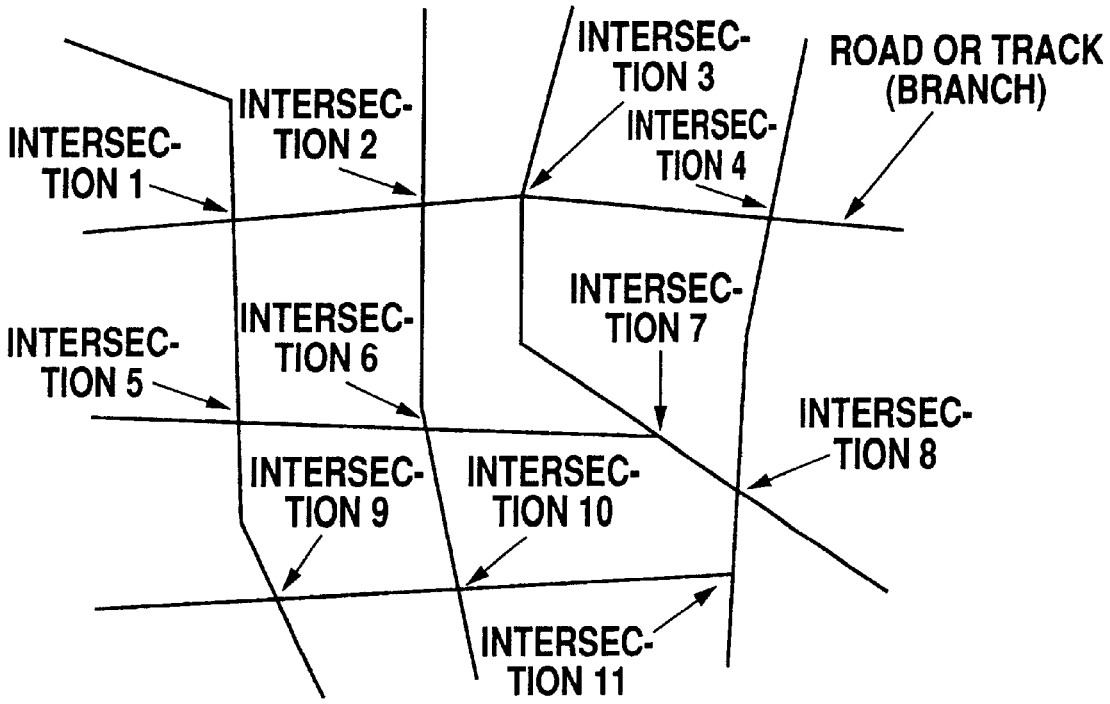
FIG. 1 conceptually shows a relationship between intersections and branches.

Prior to describing the embodiments of the present invention, the principles concerning the present invention will be described with reference to the drawings. An area to be subject to traffic control in the present invention generally includes a plurality of intersections (hereinafter also referred to as "nodes") and roads or tracks (hereinafter "branches") connecting these intersections to each other (refer to FIG. 1). If a two-dimensional coordinate system representing positions within the area is assigned in advance, the present position and destination of each vehicle can be expressed as coordinate values, and the course of each vehicle can be expressed as a set or chain comprising a branch connecting a point indicating the present position to a nearby intersection, a branch connecting this intersection to the next intersection, and so forth, and a branch connecting a final intersection to a point indicating the destination. Although for simplicity, FIG. 1 illustrates an area having no interchanges, the present invention also can apply to areas having interchanges. In such a case, a three-dimensional coordinate system may be used, or an attribute indicating that conflicts of vehicle courses cannot occur may be assigned to each interchange so as to be exempt from conflict rejection processing (to be described later). Furthermore, although slopes of the branches are not shown in FIG. 1, the influence of slope may be expressed as a longer or shorter planar distance or expressed as an attribute of each branch. No restriction need be imposed on the format of the data expressing the branches.

Figure 2:
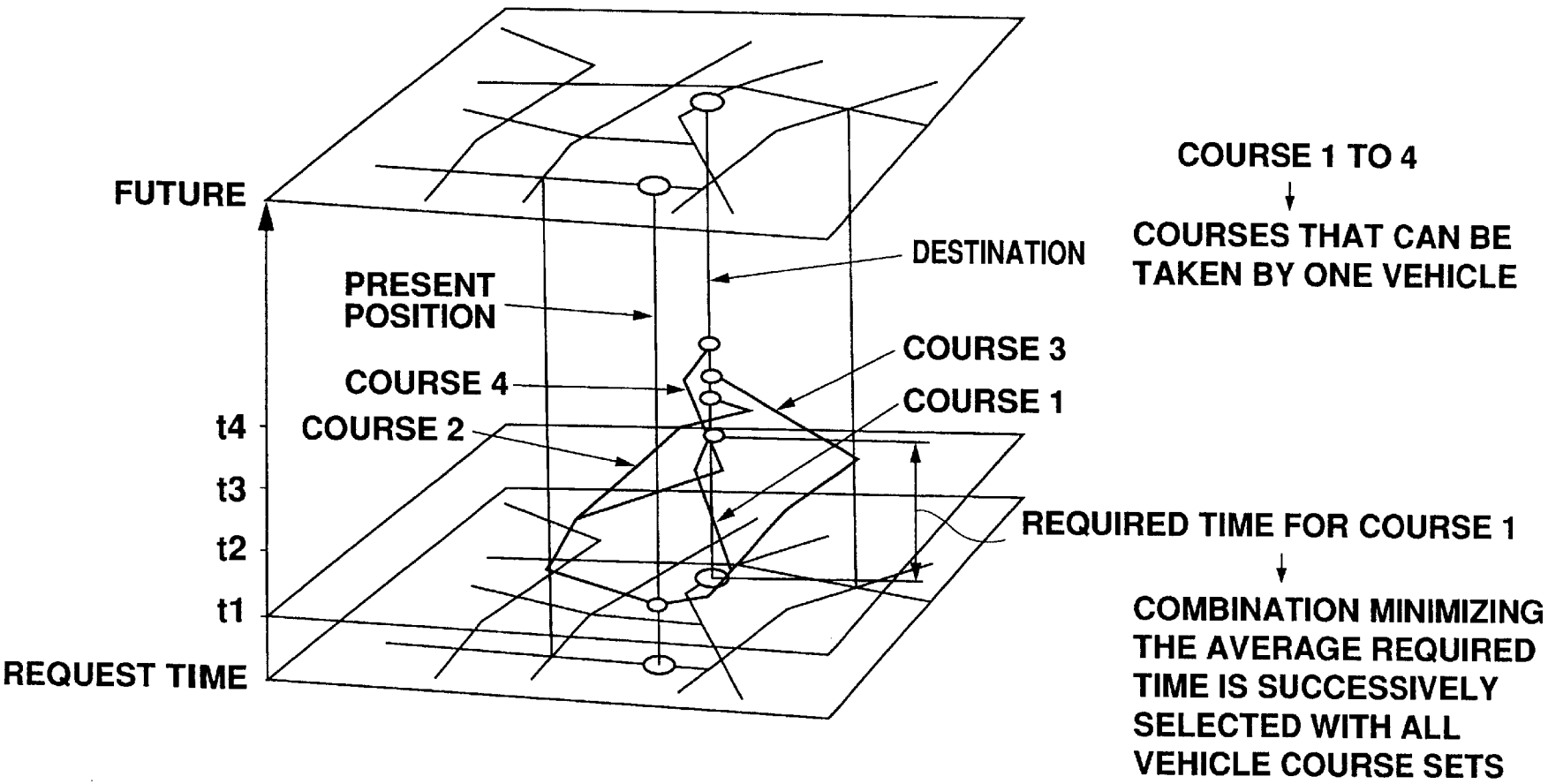
FIG. 2 spatially shows a plurality of general courses that can be taken by an arbitrary vehicle.
Figure 3A:
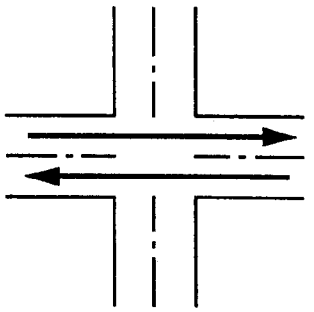
FIG. 3A shows an intersection crossing pattern known as an opposing traffic pattern, which is an example of an admissible crossing pattern where course conflicts do not occur.
Figure 3B:
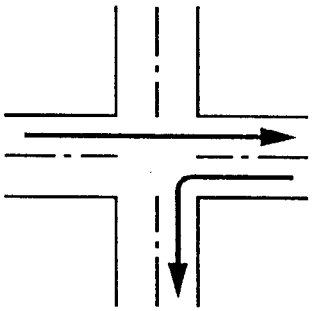
FIG. 3B shows a straight versus left turn pattern, which is another example of the admissible crossing pattern.
Figure 3C:
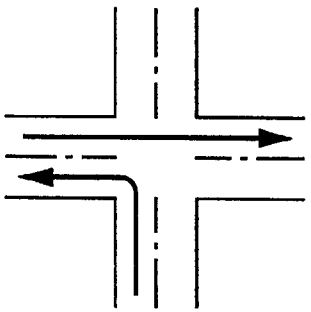
FIG. 3C shows a straight versus left turn pattern, which is another example of the admissible crossing pattern, where the vehicle making the left turn enters a lane different from the pattern shown in FIG. 3B.
Figure 3D:
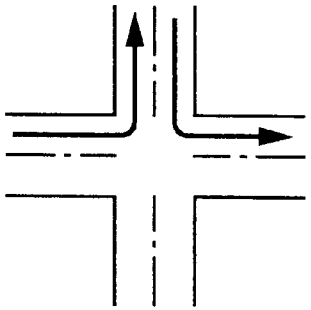
FIG. 3D shows a left turn versus left turn pattern, which is another example of the admissible crossing pattern.
Figure 3E:
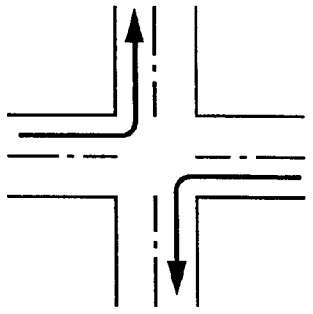
FIG. 3E shows a left turn versus left turn pattern, which is another example of the admissible crossing pattern, where one of the vehicles making the left turn enters a lane different from the pattern shown in FIG. 3D.
Figure 3F:
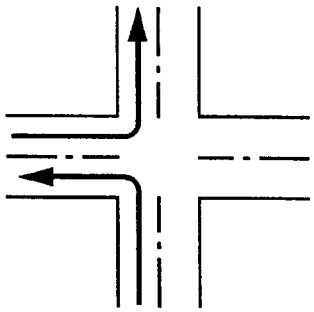
FIG. 3F shows a left turn versus left turn pattern, which is another example of the admissible crossing pattern, where one of the vehicles making the left turn enters a lane different from the patterns shown in FIGS. 3D and 3E.
Figure 3G:
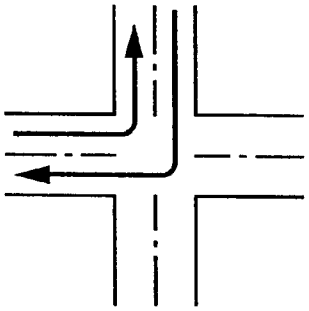
FIG. 3G shows a left turn versus right turn pattern, which is another example of the admissible crossing pattern.
Figure 4A:
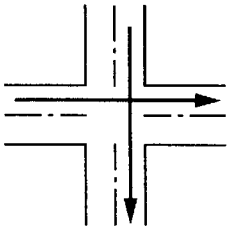
FIG. 4A shows an intersection crossing pattern known as an intersecting pattern, which is one example of an inhibited crossing pattern where course conflicts occur.
Figure 4B:
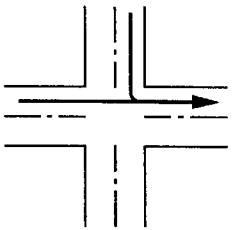
FIG. 4B shows a straight versus left turn pattern, which is another example of the inhibited crossing pattern, where the vehicle making the left turn enters a lane different from the patterns shown in FIGS. 3B and 3C.
Figure 4C:
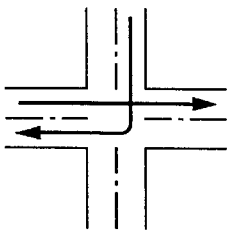
FIG. 4C shows a straight versus right turn pattern, which is another example of the inhibited crossing pattern.
Figure 4D:
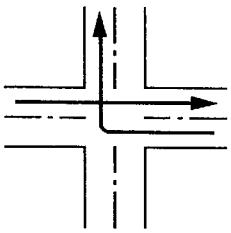
FIG. 4D shows a straight versus right turn pattern, which is another example of the inhibited crossing pattern, where the vehicle making the right turn enters a lane different from the pattern shown in FIG. 4C.
Figure 4E:
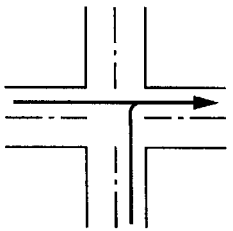
FIG. 4E shows a straight versus right turn pattern, which is another example of the inhibited crossing pattern, where the vehicle making the right turn enters a lane different from the patterns shown in FIGS. 4C and 4D.
Figure 4F:
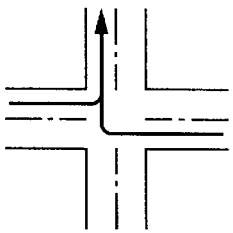
FIG. 4F shows a left turn versus right turn pattern, which is another example of the inhibited crossing pattern, where the vehicle making the right turn enters a lane different from the pattern shown in FIG. 3G.
Figure 4G:
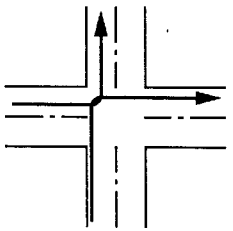
FIG. 4G shows a left turn versus right turn pattern, which is another example of the inhibited crossing pattern, where the vehicle making the right turn enters a lane different from the patterns shown in FIGS. 3G and 4F.
Figure 4H:
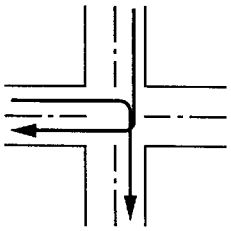
FIG. 4H shows a right turn versus right turn pattern, which is another example of the inhibited crossing pattern.
Figure 4I:
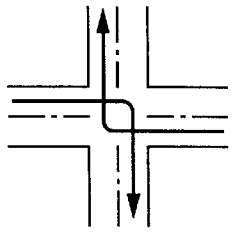
FIG. 4I shows a right turn versus right turn pattern, which is another example of the inhibited crossing pattern, where one vehicle making the right turn enters a lane different from the pattern shown in FIG. 4H.
Figure 4J:
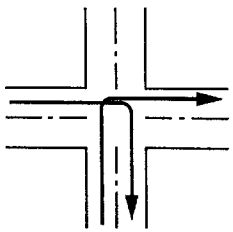
FIG. 4J shows a right turn versus right turn pattern, which is another example of the inhibited crossing pattern, where one vehicle making the right turn enters a lane different from the patterns shown in FIGS. 4H and 4I.
Figure 5A:
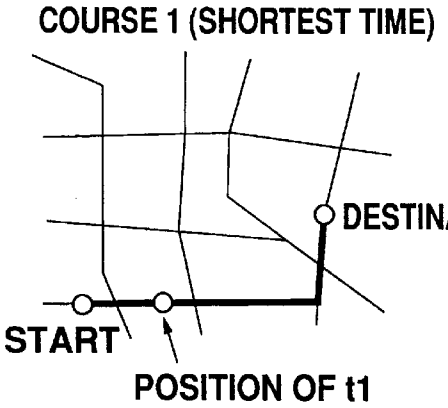
FIG. 5A is a conceptual diagram showing a course selection logic for a traveling vehicle, and in particular shows a course thought to require the shortest time to reach a destination.
Figure 5B:
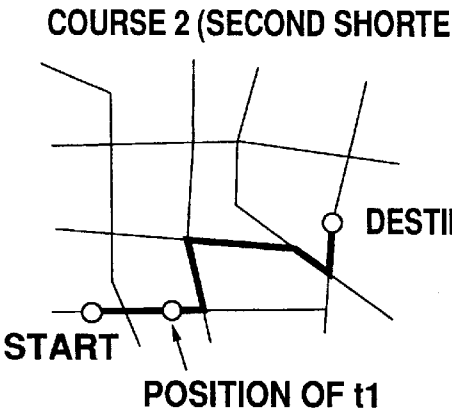
FIG. 5B is a conceptual diagram showing a course selection logic for the traveling vehicle, and in particular shows a course thought to require the second shortest time to reach the destination.
Figure 5C:
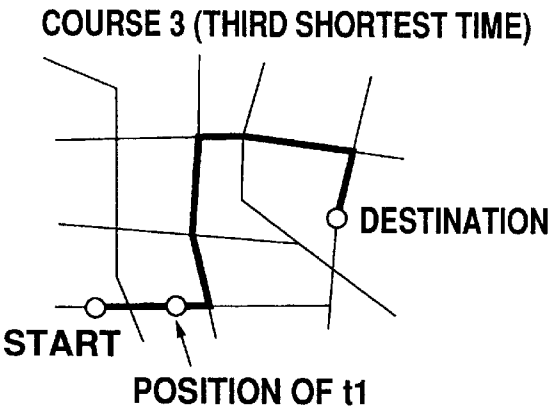
FIG. 5C is a conceptual diagram showing a course selection logic for the traveling vehicle, and in particular shows a course thought to require the third shortest time to reach the destination.
Figure 5D:
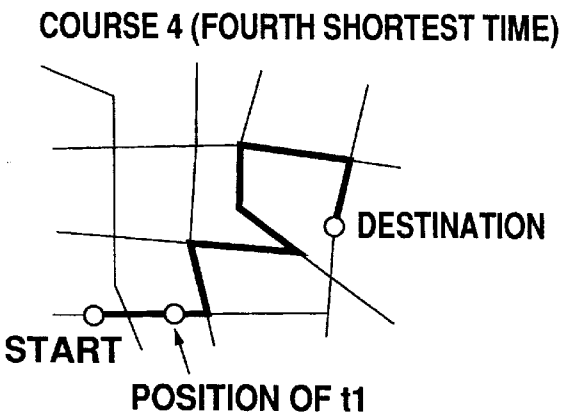
FIG. 5D is a conceptual diagram showing a course selection logic for the traveling vehicle, and in particular shows a course thought to require the fourth shortest time to reach the destination.
Figure 6A:
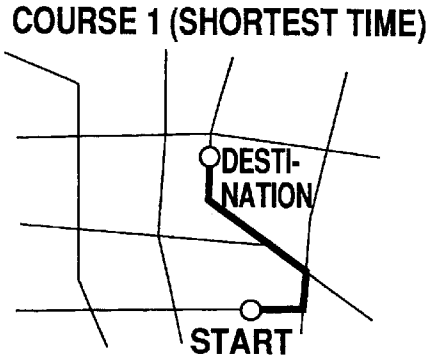
FIG. 6A is a conceptual diagram showing a course selection logic for a vehicle waiting to start travel, and in particular shows a course thought to require the shortest time to reach a destination and to allow a sufficiently long wait time at a present position.
Figure 6B:
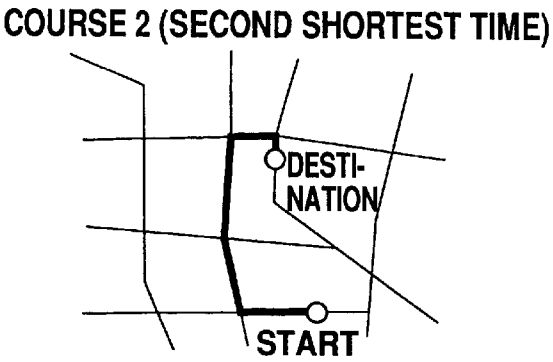
FIG. 6B is a conceptual diagram showing a course selection logic for the vehicle waiting to start travel, and in particular shows a course thought to require the second shortest time to reach the destination and to allow a sufficiently long wait time at the present position.
Figure 6C:
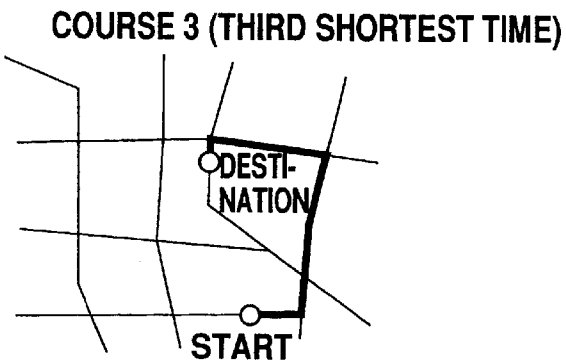
FIG. 6C is a conceptual diagram showing a course selection logic for the vehicle waiting to start travel, and in particular shows a course thought to require the third shortest time to reach the destination and to allow a sufficiently long wait time at the present position.
Figure 6D:
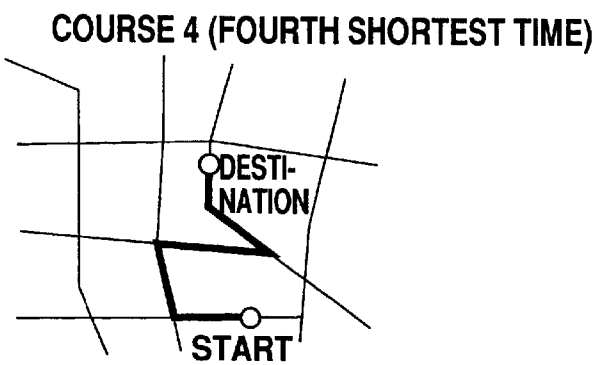
FIG. 6D is a conceptual diagram showing a course selection logic for the vehicle waiting to start travel, and in particular shows a course thought to require the fourth shortest time to reach the destination and to allow a sufficiently long wait time at the present position.

As shown in FIG. 2, changes in position of a vehicle from present time $t_1$ to future times $t_2$, $t_3$, $t_4$, and so forth can be expressed as a broken line monotonously rising from the point indicating the present position to the point indicating the destination. Generally, there are a plurality of broken lines, namely, possible courses for the vehicle from the present position to the destination. (Refer to FIG. 2, FIGS. 5A to 5D and FIGS. 6A to 6D.) For example, the examples of FIG. 2, FIGS. 5A to 5D, and FIGS. 6A to 6D each have four possible courses (courses 1 to 4) for a vehicles at the present time $t_1$. To proceed with travel of the vehicle subsequent to present time $t_1$, one of the possible courses must be selected. This selection is referred to herein as course selection. In the conventional VICS, information, such as on road congestion, is provided to each vehicle over the radio channels so as to assist the driver of each vehicle in course selection, and in this respect, VICS is useful, such as in quickly reaching a destination or avoiding traffic congestion. However, with only VICS, it is impossible to optimize the traffic of many vehicles traveling or about to travel within a certain tract of area and to enable the destination to be quickly reached for each vehicle without becoming caught in traffic congestion or without frequent stopping and starting. One reason for this limitation is that a function for centralized control of courses for a plurality of vehicles and a function for deciding or coordinating the course of a vehicle according to the course of other vehicles are not provided. These functions are provided in the present invention in the following manner.

First, it is assumed there are N number of intersections within a given area. A possible course for an arbitrary vehicle can be expressed as a set of information, such as which of the N intersections will be crossed and at what time the vehicle will cross the intersections. For example, when an i-th vehicle selects a $j_i$-th possible course, if the estimated time of crossing a k-th intersection is expressed as $T_{i.ji.k}$, and $T_{i.ji.k}=0$ is set for intersections that are not crossed, each course can be expressed as a N-dimensional vector $T_{i.ji}=[T_{i.ji.k}]$. Furthermore, the state of vehicle traffic in that area in the near future is determined by a combination of the course taken by the first vehicle, the course taken by the second vehicle, . . . , and the course taken by the n-th vehicle. Therefore, the state of vehicle traffic in that area in the near future can be realized by a n-row, N-column matrix $T_c$ given in the following expression where row is given by i-th one of N-dimensional vectors $T_{i.ji}$.

$$Tc = \begin{bmatrix} T_{1\cdot j1} \\ T_{2\cdot j2} \\ \vdots \\ T_{i\cdot ji} \\ \vdots \\ T_{n\cdot jn} \end{bmatrix} = \begin{bmatrix} T_{1\cdot j1\cdot 1} & T_{1\cdot j1\cdot 2} & \cdots & T_{1\cdot j1\cdot k} & \cdots & T_{1\cdot j1\cdot N} \\ T_{2\cdot j2\cdot 1} & T_{2\cdot j2\cdot 2} & \cdots & T_{2\cdot j2\cdot k} & \cdots & T_{2\cdot j2\cdot N} \\ \vdots & \vdots & & \vdots & & \vdots \\ T_{i\cdot ji\cdot 1} & T_{i\cdot ji\cdot 2} & \cdots & T_{i\cdot ji\cdot k} & \cdots & T_{i\cdot ji\cdot N} \\ \vdots & \vdots & & \vdots & & \vdots \\ T_{n\cdot jn\cdot 1} & T_{n\cdot jn\cdot n} & \cdots & T_{n\cdot jn\cdot k} & \cdots & T_{n\cdot jn\cdot N} \end{bmatrix} \quad (1)$$

where

Tc: n-row, N-column matrix expressing a combination of one of the first vehicle's possible courses, one of the second vehicle's possible courses, . . . , and one of the n-th vehicle's possible courses, within a service area having N-number of intersections.

$T_{i.ji}$: N-dimensional vector expressing the $j_i$-th course among the courses the i-th vehicle may take.

$T_{i.ji.k}$: estimated time for the i-th vehicle to cross the k-th intersection when the $j_i$-th course was taken. $T_{i.ji.k}=0$ when the intersection is not to be crossed.

i=1, 2, . . . , n $j_i$=1, 2, . . . , $j_{imax}$ k=1, 2, . . . , N n: number of vehicles located within service area $j_{imax}$: number of courses that may be taken by the i-th vehicle N: number of intersections located within service area N, $j_{imax}$, N: Natural numbers The matrix $T_c$ expresses a combination of possible courses, the number of which is $N_c$ as given in the following expression when the number of possible courses for the i-th vehicle is expressed as $j_{imax}$.

$$N_c = j_{1max} \times j_{2max} \times \ldots \times j_{nmax} \quad (2)$$

Optimizing the traffic of vehicles can be achieved by successively selecting, from among $N_c$-number of combinations $T_c$ at times $t_1$, $t_2$, $t_3$, $t_4$, and so forth, a course that allows a destination to be quickly reached without each vehicle becoming caught in traffic congestion and without frequent stopping and starting. Namely, in the present invention, a combination is selected as shown in FIG. 2, from $N_c$-number of combinations $T_c$, in which the average time required for all vehicles to reach their destinations from their present positions is shortest. If the courses concerning the selected combination are to be traveled by the vehicles, all vehicles within the area can reach their destinations in relatively short times without encountering traffic congestion.

Furthermore, in the present invention, in order to avoid traffic congestion and frequent stopping and starting, combinations causing situations in which a plurality of vehicles cross an identical intersection at or around the same time are, as a rule, eliminated from the above-mentioned selection. If the vehicles travel the courses concerning the selected combination, a plurality of vehicles do not cross an identical intersection at or around the same time, and stopping and starting at the intersections are eliminated so that destinations can be quickly reached, resulting in improvements in energy efficiency, and in particular reductions in emissions when it is gasoline cars that are controlled.

Furthermore, in the present invention, even for combinations causing situations where a plurality of vehicles cross an identical intersection at or around the same time, only admissible crossing patterns are yielded. Eliminating only the combinations where an inhibited crossing pattern occurs from the above-mentioned elimination maximizes the number of selectable combinations without causing conflicts. The admissible crossing pattern mentioned herein is a vehicle crossing pattern where conflicts do not occur (refer to FIGS. 3A to 3G) whereas the inhibited crossing pattern is a vehicle crossing pattern where conflicts do occur (refer to FIGS. 4A to 4J). FIGS. 3A to 3G and FIGS. 4A to 4J depict examples where two vehicles enter a simple right angle intersection. However, it should be easy for a person having ordinary skill in the art to reference this application and expand the examples to cover three-way and five-way intersections and situations where three or more vehicles enter an intersection.

Furthermore, in the present invention, a vehicle that has not started travel at present time $t_1$ is also subject to waiting control and command and is started at an appropriate timing so that the vehicle need not stop and start at intersections and is not caught in traffic congestion (refer to FIGS. 5A to 5D and FIGS. 6A to 6D). Namely, so that the destination is reached quickly and so that the destination is reached via high-speed travel without stopping once travel has commenced, the departure time from the starting point is delayed by an amount so as not to appreciably delay the arrival time. In the present invention, furthermore, the vehicle speed necessary when calculating the estimated crossing time $T_{i.ji.k}$ is appropriately set for every branch so as to maximize the amount of traffic in the entire area, to shorten the wasted time before starting, and to preferentially shorten the travel time of vehicles having a relatively long start time.

(2) Processing Overview

An overview of the processing in the present invention will be described next. In the present invention, the above-mentioned vector $T_{i.ji}$ is generated and matrix $T_c$ is further generated. To determine the estimated crossing times $T_{i.ji.k}$, which are components of matrix $T_c$, information on the present position, destination, and on vehicle speed and travel/start at each branch are required. Among these, the present position can be obtained from detection or input by a vehicle passenger. The destination can be obtained from input by the vehicle passenger, or from estimation on the basis of present position and speed. The travel or start state can be determined from detection, or from input by the vehicle passenger.

$$v_{0k(k+1)}=v_0 \text{ or } v_i \tag{3}$$

where $v_{0k(k+1)}$: *speed the vehicle takes at branch Lk(k+1)*

$L_{k(k+1)}$: road (branch) connecting a k-th intersection with a k+1-th intersection $v_0$: constant $v_i$: speed of vehicle at present time $t_1$ ($v_0$ when starting)

As shown in expression 3 above, for the speed at each branch, either constant $v_0$, or a detected value or input value $v_i$ of the speed of each vehicle at present time $t_1$ may be used. In particular, using constant $v_0$ for the speed simplifies calculations for determining matrix $T_c$. Furthermore, using present speed vi in the processing for that vehicle makes it possible to obtain matrix $T_c$ with contents more accurately reflecting the actual traveling state of each vehicle. The following expression 4 may be used to successively adapt the speed in each branch. In this expression, F is a term for increasing the overall system traffic without congestion by increasing the speed in branches having a large amount of vehicular traffic, G is a term for having a vehicle forced to remain waiting for a extended time to travel at the highest speed possible after starting so as to shorten the average time required for the vehicle to reach its destination, and H is a term for shortening on the average the start time for each vehicle so as to shorten the time required to reach the destination and to help prevent passengers from becoming impatient due to the waiting time. Terms F, G, and H need not all be included in the expression.

$$v_{0k(k+1)}=v_{0k(k+1)}+F(n_{k(k+1)})+G(n_{wk(k+1)}+H(S_{wk(k+1)}) \tag{4}$$

where F(●), G(●), H(●): functions $n_{k(k+1)}$: number of vehicles expected to pass branch $L_{k(k+1)}$ $n_{wk(k+1)}$: number of vehicles among the vehicles expected to pass branch $L_{k(k+1)}$ having a start time greater than a predetermined value $S_{wk(k+1)}$: weighted combination (summation) of start time of vehicles expected to pass branch $L_{k(k+1)}$ Furthermore, in order to also subject the start time until start to traffic control, expected crossing times $T_{i.ji.k}$, which are components of matrix $T_c$, include start times $t_{wi.ji}$ as unknown components. For all $j_i$ for vehicles during travel, $t_{wi.ji}=0$. Furthermore, for course set selection based on the expected time, expected time $T_{gi.ji}$ is calculated for all $j_{1max}+j_{2max}+\ldots j_{nmax}$ number of vectors $T_{i.ji}$. Expected time $T_{gi.ji}$ also includes start time $t_{wi.ji}$ as an unknown portion.

In the present invention, matrix $T_c$ created in this manner is used to detect conflict between courses of vehicles at each intersection. Namely, if the condition given in expression 5 below at the k-th intersection is satisfied when the i-th vehicle takes the $j_i$-th course, no conflict is assumed to occur between the course of the i-th vehicle and the courses of other vehicles at the k-th intersection even if the first vehicle takes the number $j_1$ course, the second vehicle takes the number $j_2$ course, and the n-th vehicle takes the $j_n$-th course. The conflict mentioned herein signifies that the distance between vehicles falls below a predetermined lower limit. If the above-mentioned condition is not satisfied and the relative relation of courses of a plurality of vehicles approaching the k-th intersection corresponds to an admissible crossing pattern, it is assumed that conflict does not occur. Combinations for which conflict is assumed not to occur are subjected to selective determination in subsequent processing.

$$|T_{i.ji.k}-T_{1.j1.k}|>\Delta T_k,\ |T_{i.ji.k}-T_{2.j2.k}|>\Delta T_k,\ \ldots,\ \text{and}\ |T_{i.ji.k}-T_{n.jn.k}|>\Delta T_k \tag{5}$$

where i=1, 2, . . . , n $j_i$=1, 2, . . . , $j_{imax}$ k=1, 2, . . . , N $\Delta T_k$=(lower limit of distance between vehicles)/(speed to be taken at originating branch)

Furthermore, since the expected crossing time $T_{i.ji.k}$ includes the start time $t_{wi.ji}$ as a variable, the start time $t_{wi.ji}$ must be settled beforehand to determine on the basis on the timing for crossing an intersection whether conflict is to occur at the intersection. Conversely, the timing for crossing for which conflict is thought not to occur is sought by gradually varying start time $t_{wi.ji}$, and if such a timing for crossing is found, the start time $t_{wi.ji}$ at that time sets the start time $t_{wi.ji}$ to be used in subsequent processing. Thus, the start time $t_{wi.ji}$ can be set by this sort of trial and error process. For example, the start time $t_{wi.ji}$ can be set from the next expression 6.

$$t_{wi\cdot ji} = \begin{cases} 0: & \text{when conflict does not occur with } t_{wi\cdot ji} = 0 \\ \Delta T + \alpha: & \text{when conflict occurs with } t_{wi\cdot ji} = 0 \end{cases} \quad (6)$$

where $t_{wi.ji}$: start time when the i-th vehicle takes the $j_i$-th course $\alpha$: minimum positive value where conflict does not occur After courses in which conflict occurs are eliminated from the selection in this manner, the expected crossing time $T_{i.ji.k}$ is set on the basis of the set start time $t_{wi.ji}$, and course selection is executed using the set expected crossing time $T_{i.ji.k}$. Namely, by selecting, among $N_c$ number of matrixes $T_c$, a combination where the average value $T_{m.j1.j2 \ldots n}$ of the expected time $T_{gi.ji}$ is equal to the minimum average expected time $T_{min}$ expressed in expression 7, a combination of courses to be taken by vehicles located within the area can be obtained as an n-row, N-column matrix $T_t$ in expression 8. If a plurality of $T_t$ exists, one is selected on the basis of start time $t_{wi.ji}$.

$$\text{Tmin} = \min(T_{m.ji.j2 \ldots jn}) \quad (7)$$

where min(.): minimum value for all combinations, where conflict does not occur, of j1, j2, . . . , jn $T_{m.ji.j2 \ldots jn} = (T_{g1.ji} + T_{g2.j2} + \ldots + T_{gn.jn})/n$: average expected time of all vehicles when the i-th vehicle takes the $j_1$-th course, the second vehicle takes the $j_2$-th course, . . . , and the n-th vehicle takes the $j_n$-th course.

$T_{gi.ji}$: expected time when the i-th vehicle takes the $j_i$-th course.

$$T_t = \begin{bmatrix} T_{t1} \\ T_{t2} \\ \vdots \\ T_{ti} \\ \vdots \\ T_{tn} \end{bmatrix} = \begin{bmatrix} T_{t11} & T_{t12} & \ldots & T_{t1k} & \ldots & T_{t1N} \\ T_{t21} & T_{t22} & \ldots & T_{t2k} & \ldots & T_{t2N} \\ \vdots & \vdots & & \vdots & & \vdots \\ T_{ti1} & T_{ti2} & \ldots & T_{tik} & \ldots & T_{tiN} \\ \vdots & \vdots & & \vdots & & \vdots \\ T_{tn1} & T_{tn2} & \ldots & T_{tnk} & \ldots & T_{tnN} \end{bmatrix} \quad (8)$$

where $T_t$: n-row, N-column matrix showing a combination among all course sets, having (1) no (or minimal) conflict at intersections, and (2) $T_{m.ji.j2 \ldots jn} = T_{min}$. If there are more than one combination satisfying these conditions, a selection is made where (a) $t_{wi.ji}$ is minimized for a specific vehicle, (b) average value of $t_{wi.ji}$ of all vehicles is minimized, etc.

$T_{ti}$: N-dimensional vector indicating a course (command) to be taken by the i-th vehicle.

$T_{tik}$: time when the i-th vehicle crosses the k-th intersection (vehicle does not cross when $T_{tik}=0$)

In the present invention, the matrix $T_t$ or each of the N-dimensional vectors $T_{ti}$ comprising one of the row components thereof is obtained at each vehicle located within the area or transmitted to each vehicle from the control station so as to inform the vehicle operator or for furnishing to the vehicle travel control system as a control command. As a result, the vehicular traffic within that area can be optimized and improvements in energy efficiency, for example, can be achieved. Furthermore, since information regarding the start time $t_{wi.ji}$ of each vehicle is included in the determined matrix $T_t$ or each of the N-dimensional vectors $T_{ti}$ comprising one of the row components thereof, adjustment or control of the start time $t_{wi.ji}$ can be further performed for waiting idle vehicles, resulting in optimization of vehicular traffic and improvements in energy efficiency, for example. Furthermore, a process to increase the speed in a branch having a large number of passing vehicles enables traffic in the overall area to be increased without congestion, and increasing the speed in each branch through which pass a large number of vehicles having long start times $t_{wi.ji}$ or determining the speed in each branch so that the start times in the overall area becomes short on the average enables discomfort due to waiting to be alleviated as well as traffic to be increased.

(3) Embodiments using vehicle—vehicle radio communications

Embodiments of the present invention include embodiments applicable to road traffic systems and embodiments applicable to tracked traffic systems. The embodiments applicable to road traffic systems further include an embodiment using vehicle—vehicle radio communications, an embodiment performing radio-based vehicle control, and an embodiment using both vehicle—vehicle radio communications and radio-based vehicle control. Hereinafter will be described in sequence the embodiment using vehicle—vehicle radio communications in the road traffic system, the embodiment performing radio-based vehicle control in the road traffic system (includes the embodiment using both vehicle—vehicle radio communications and radio-based vehicle control), and the embodiment applicable to the tracked traffic system.

Figure 7:
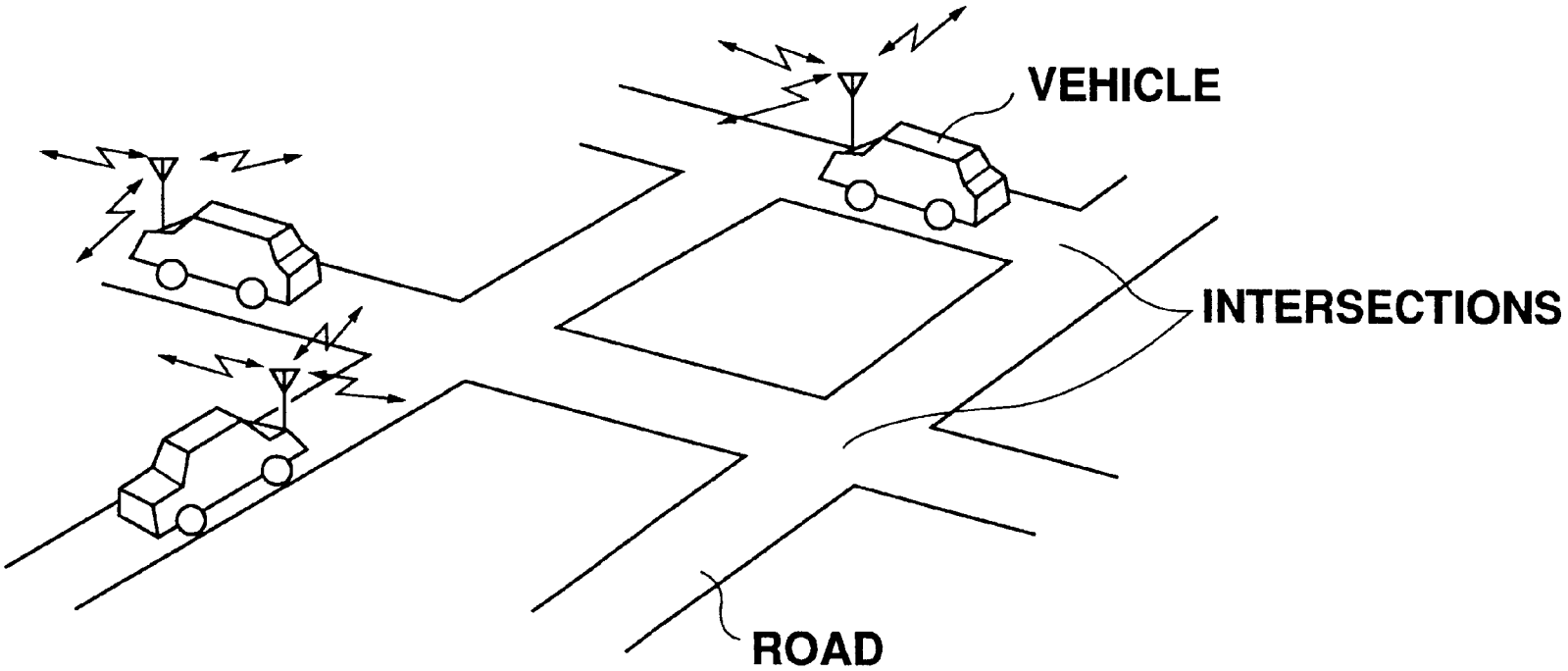
FIG. 7 shows a system configuration of an embodiment using vehicle to vehicle radio communications.

First, as shown in FIG. 7, in embodying the present invention in the road traffic system in which vehicles travel on roads, each vehicle is equipped with a mobile set having radio communication functions for performing radio communications between vehicles or between vehicle and control station. If the present invention is to be embodied with vehicle—vehicle radio communications and without a control station, the configurations shown in FIGS. 8 to 11 may be used in each vehicle apparatus.

Figure 8:
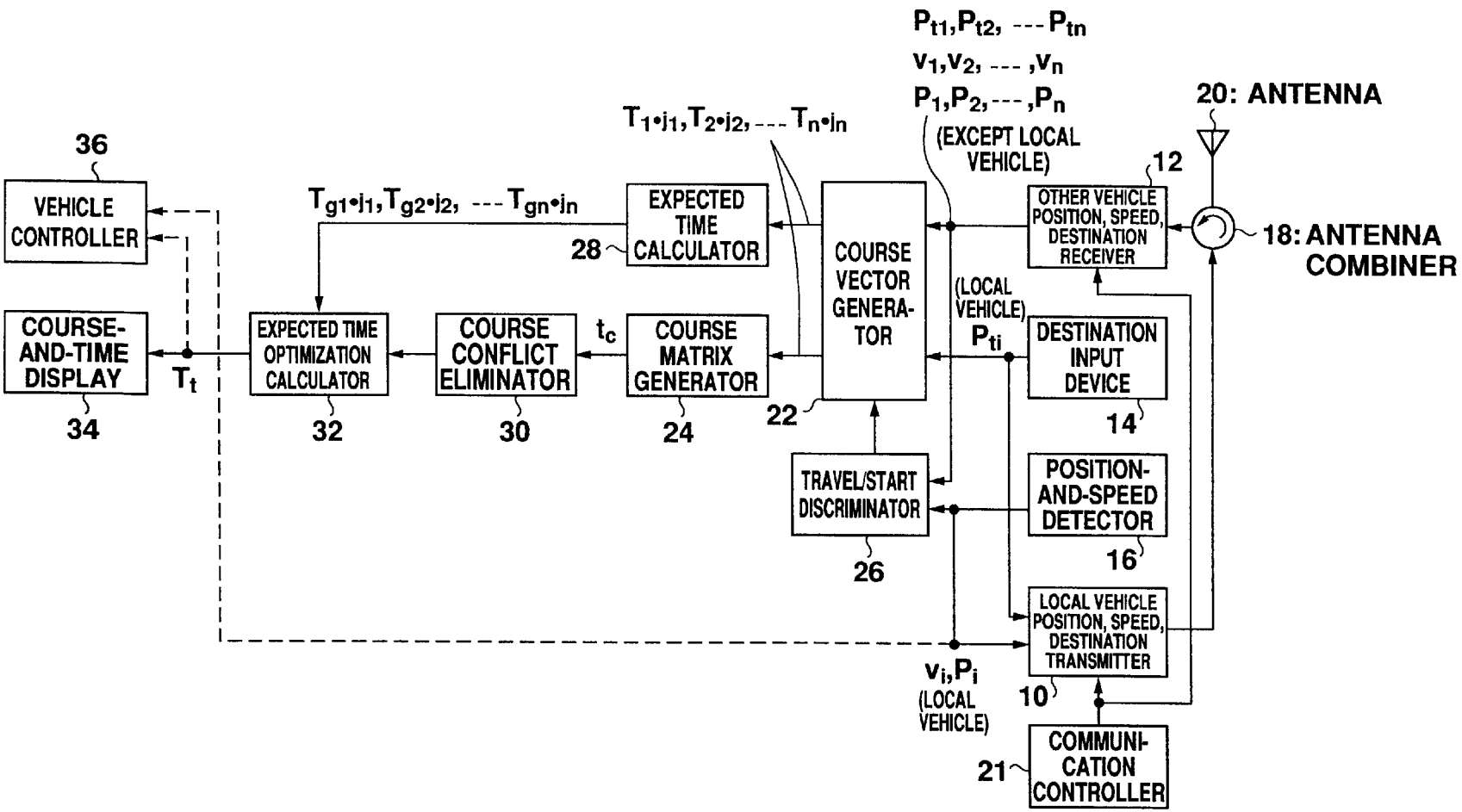
FIG. 8 is a functional block diagram of a mobile set in the first and fifth embodiments of the present invention.

First, the vehicle apparatus of a first embodiment shown in FIG. 8 includes a transmitter 10 and a receiver 12. The transmitter 10 wirelessly transmits, by an antenna 20 via an antenna combiner 18, a destination that is input by a vehicle passenger operating a destination input device 14 (such as keypad or voice input device), and a present position and speed of the vehicle that are detected by a detector (such as navigation device or speed sensor) 16. The receiver 12 receives through the antenna 20 via the antenna combiner 18 the information, namely, the destinations, present positions, and speeds of other vehicles, that are transmitted by radio from the vehicle apparatuses (mobile sets) carried in the other vehicles. The operation of these functional members results in the gathering of information indicating the destination, present position, and speed of the local vehicle and other vehicles. A communication controller 21 controls the radio communications through the transmitter 10 and receiver 12 so that there is no clash of information on radio channels connecting the vehicle with other vehicles and so that the reception of information is performed without significant error. This control can utilize known mobile communication techniques.

The gathered information is used in the generation of the above-mentioned N-dimensional vectors $T_{i.ji}$ at a course vector generator 22, and the generated vectors $T_{i.ji}$ are used in the generation of the n-row, N-column matrix $T_c$ at a course matrix generator 24 (refer to expression 1). Furthermore, a discriminator 26 determines whether each vehicle is traveling or waiting on the basis of information regarding speed obtained from the detector 16 or receiver 12. According to the result, the course vector generator 22 generates vector $T_{i.ji}$ by substituting 0 (during travel) or an unknown value (during waiting) for the start time $t_{wi.ji}$. Furthermore, the speed to be taken at each branch is determined by expression 3, the result of which is used in the generation of vector $T_{i.ji}$. Furthermore, based on the vector $T_{i.ji}$, an expected time calculator 28 calculates a time $T_{gi.ji}$ required for each vehicle to reach a respective destination. However, the start time $t_{wi.ji}$ of a waiting vehicle at the present time $t_1$ is kept as an unknown value.

A conflict eliminator 30 eliminates course patterns indicating course sets in which course conflicts may occur at intersections from possible course patterns indicating course sets, one of which would be selected as a course pattern that the vehicles are to finally take, from among the $N_c$ types (refer to expression 2) of matrices $T_c$. Namely, as shown in expression 5, course patterns including any one of the inhibited crossing patterns (refer to FIGS. 4A to 4J) are eliminated from possible course patterns. At this time, the conflict eliminator 30 determines the start time $t_{wi.ji}$ for each possible course for waiting vehicles as shown in expression 6. An expected time optimization calculator 32 determines the expected time $T_{gi.ji}$ by substituting the start time $t_{wi.ji}$ obtained at the conflict eliminator 30 for the unknown portion in the expected time $T_{gi.ji}$ obtained at the expected time calculator 28, and performs the calculation shown in expression 7 using this expected time $T_{gi.ji}$. The expected time optimization calculator 32 further selects a matrix $T_c$ which makes average values $T_{m.j1.j2.\ldots jn}$ in of the expected time $T_{gi.ji}$ equal to minimum value $T_{min}$, from a plurality of matrices $T_c$ that generally exist at this stage. As a result of selecting a matrix $T_c$, matrix $T_t$ shown in expression 8 is obtained.

Therefore, an optimum course can be suggested to the vehicle operator by displaying, among the obtained matrix $T_t$, at least information on the course (includes start time) of the local vehicle, such as maps showing intersections to be passed and recommended (predicted) crossing times of the intersections, on a screen of a course-and-time display 34 (such as a miniature CRT or LCD) carried in the vehicle. The same information may also be supplied to a vehicle controller 36, which controls such operations as vehicle drive train, braking system, and steering system, for automatic or semi-automatic driving. As shown by the broken line in the figure, the present position and speed detected by the detector 16 can be utilized for automatic or semi-automatic driving of the vehicle. According to this embodiment, the start time and course of each vehicle can be controlled so that there are no conflicts at the intersections. Furthermore, since control stations are not required, extra infrastructure costs are not generated. In addition, since vector $T_{i.ji}$ is determined to minimize acceleration and deceleration, the energy efficiency of the traffic system as a whole improves. When gasoline vehicles are used, for example, gas emissions are reduced.

Figure 9:
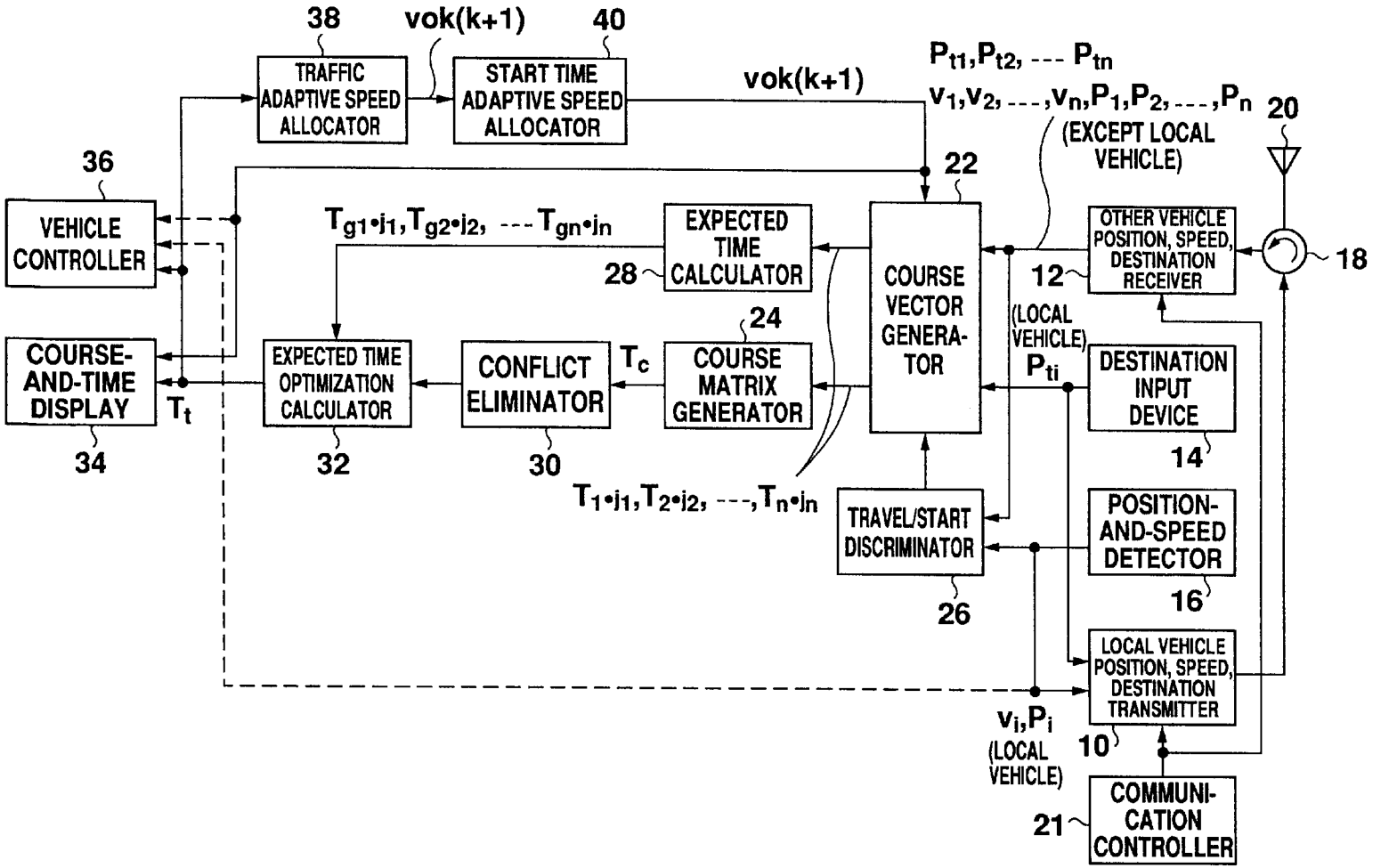
FIG. 9 is a functional block diagram of the mobile set in the second and fifth embodiments of the present invention.

In the vehicle apparatus of a second embodiment shown in FIG. 9, a traffic adaptive speed allocator 38 and a start time adaptive speed allocator 40 are provided so that the speeds used in the course vector generator 22, namely, the speeds to be taken in each branch, are set according to the traffic and start times. The traffic adaptive speed allocator 38 obtains, from matrix $T_t$, term F in expression 4 and the start time adaptive speed allocator 40 obtains terms G and H, the results of which are used to adapt the speed $v_{0k(k+1)}$. Thus, this embodiment enables processing to increase the speeds at branches with high traffic while permitting acceleration and deceleration to some extent, to increase the speeds at branches through which vehicles forced to wait a long time until starting will pass frequently and to increase the speed at each branch when the average start time in the entire area appears to lengthen. This allows increases in the traffic while maintaining the energy efficiency at a certain level, and shortens the start times. Furthermore, by supplying speeds $v_{0k(k+1)}$ to be set to the course-and-time display 34, the recommended or predicted speeds at each branch under the present traffic conditions can be informed to the vehicle passenger, and by supplying it to the vehicle controller 36, the vehicle controller 36 can realize those speeds while the acceleration and deceleration are minimized.

Figure 10:
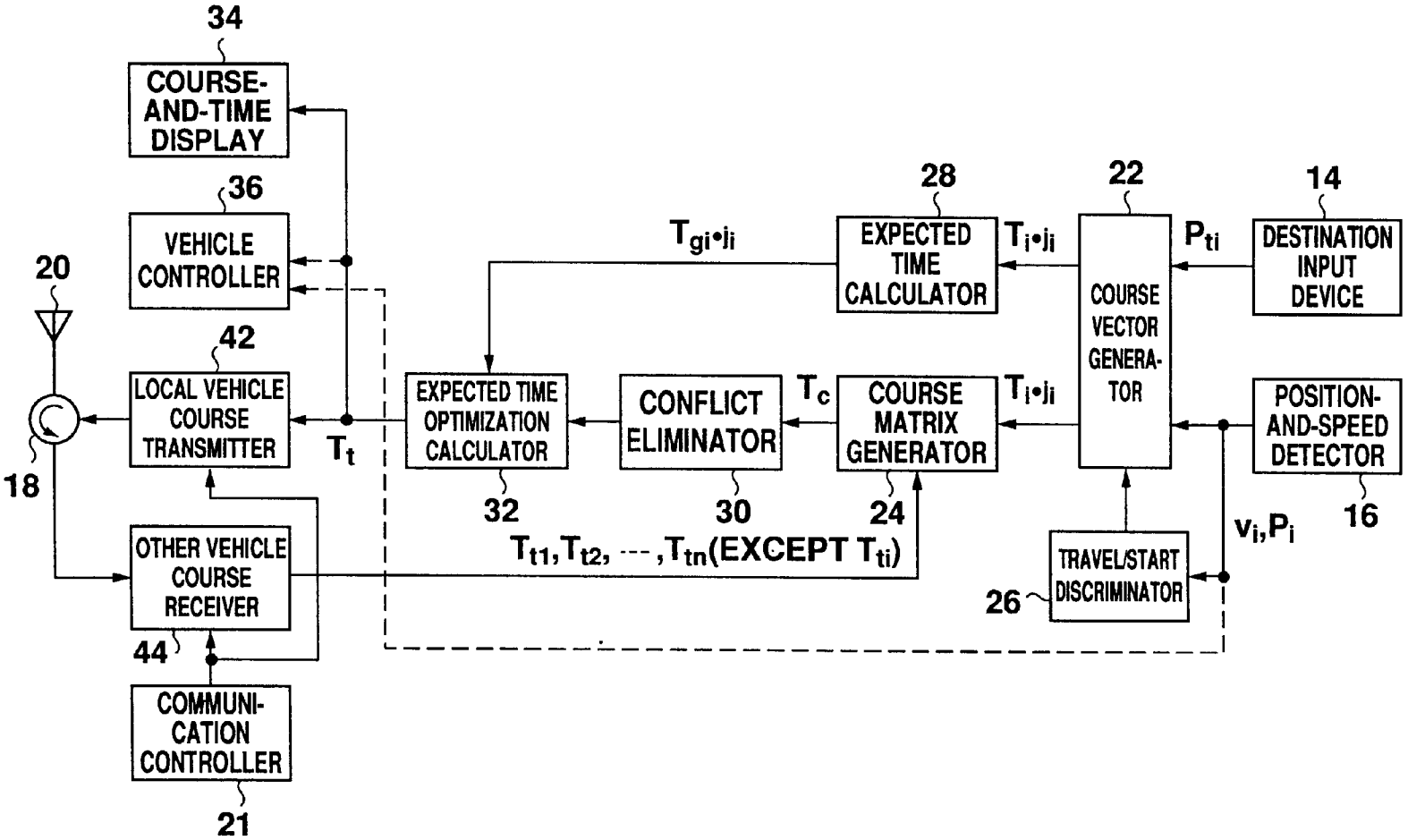
FIG. 10 is a functional block diagram of the mobile set in the third and sixth embodiments of the present invention.
Figure 11:
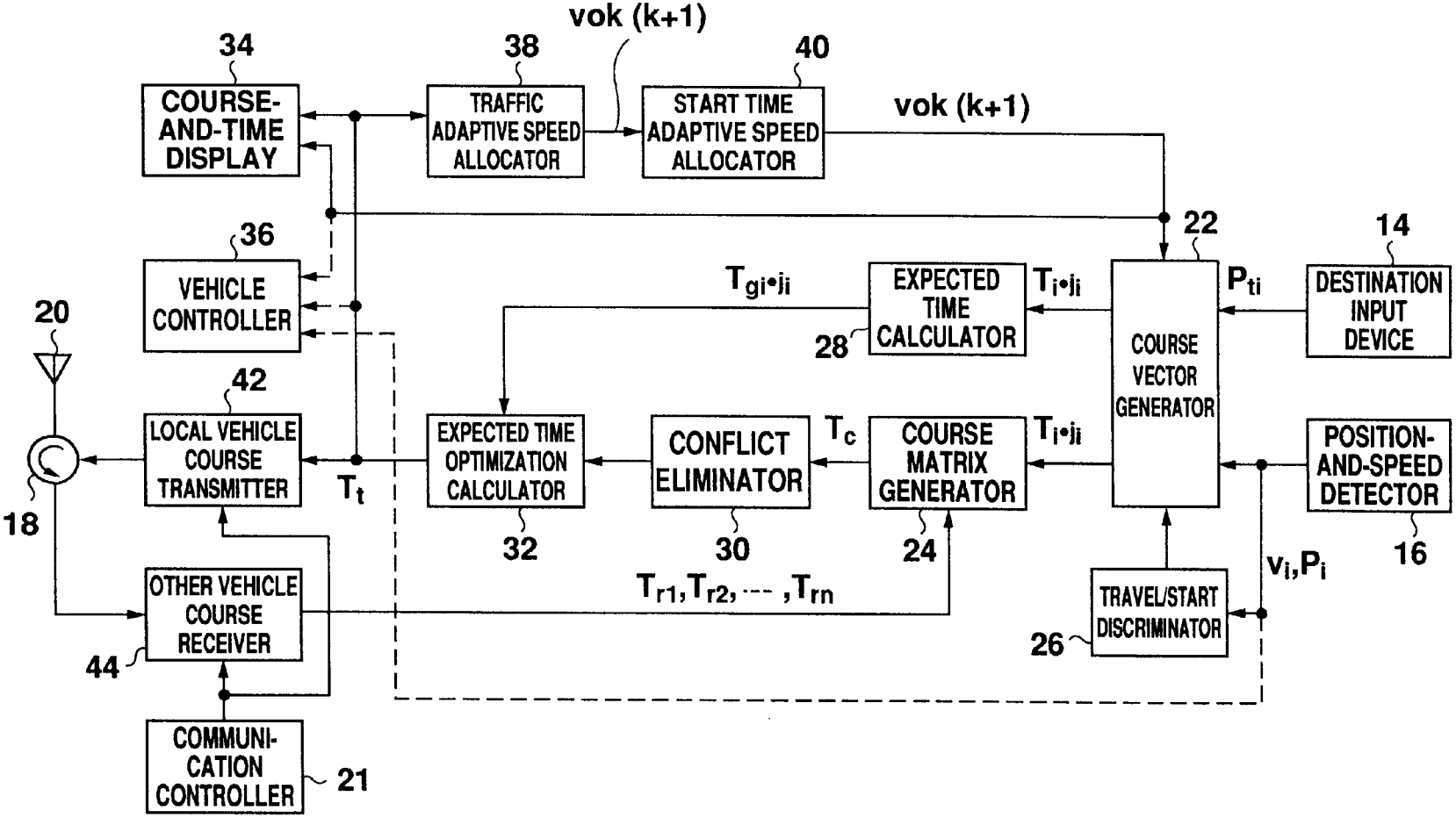
FIG. 11 is a functional block diagram of the mobile set in the fourth and sixth embodiments of the present invention.

In the vehicle apparatus of a third embodiment shown in FIG. 10, a transmitter 42 and a receiver 44 are provided to transmit and receive the course of each vehicle instead of the destination, present location, and speed of each vehicle. The transmitter 42 on one vehicle extracts the vector (includes the start time) indicating the course of the local vehicle among the matrix $T_t$ obtained from the same process as in the first embodiment, and transmits using the antenna 20 via the antenna combiner 18 the extracted rector information. The receiver 44 on another vehicle receives the thus-transmitted rector information through the radio channel provided between these two vehicles using the antenna 20 via the antenna combiner 18, and by repeating this operation, collects n-dimensional vectors $T_{ti}$ each indicating the course of the other vehicle and supplies the collected n-dimensional vectors $T_{ti}$ to the course matrix generator 24. The course matrix generator 24 uses vectors $T_{ti}$ as the components of matrix $T_c$ regarding the other vehicles, as shown in the following expression 9, when generating matrix $T_c$. In other words, in this embodiment, the generation of vectors $T_{i.ji}$ indicating the possible courses of the other vehicles is not performed at the course vector generator 22, and vectors $T_{ti}$ indicating the courses determined at the other vehicles are used. The communication controller 21 in this embodiment controls the transmitter 42 and the receiver 44.

$$T_C = \begin{bmatrix} T_{t1} \\ T_{t2} \\ \vdots \\ T_{t(i-1)} \\ T_{i.ji} \\ T_{t(i+1)} \\ \vdots \\ T_{tn} \end{bmatrix} \tag{9}$$

Thus, in this embodiment, the number of matrices $T_c$ decreases from the number given in expression 2 to the number given in expression 10. Therefore, compared to the first and second embodiments, the amount of calculation processing among the course vector generator 22 to the expected time optimization calculator 32 decreases substantially. Furthermore, since only the information regarding the local vehicle need be transmitted as in the first and second embodiments, the amount of information to be transmitted over the radio channels between vehicles can be limited. Although a slight delay in the determination of the course in each vehicle occurs since the other vehicle's courses are collected and used by the vehicle to determine the course at each vehicle, this delay can be limited so as to be negligible, because it is possible to reduce the amount of calculation processing and increase the frequency of course selections. Furthermore, modifying this embodiment as necessary in order to obtain the second embodiment from the first embodiment, the configuration shown in FIG. 11 (fourth embodiment) can be obtained.

$$Nc=jimax \quad (10)$$

(4) Embodiment performing radio-based vehicle control

Figure 12:
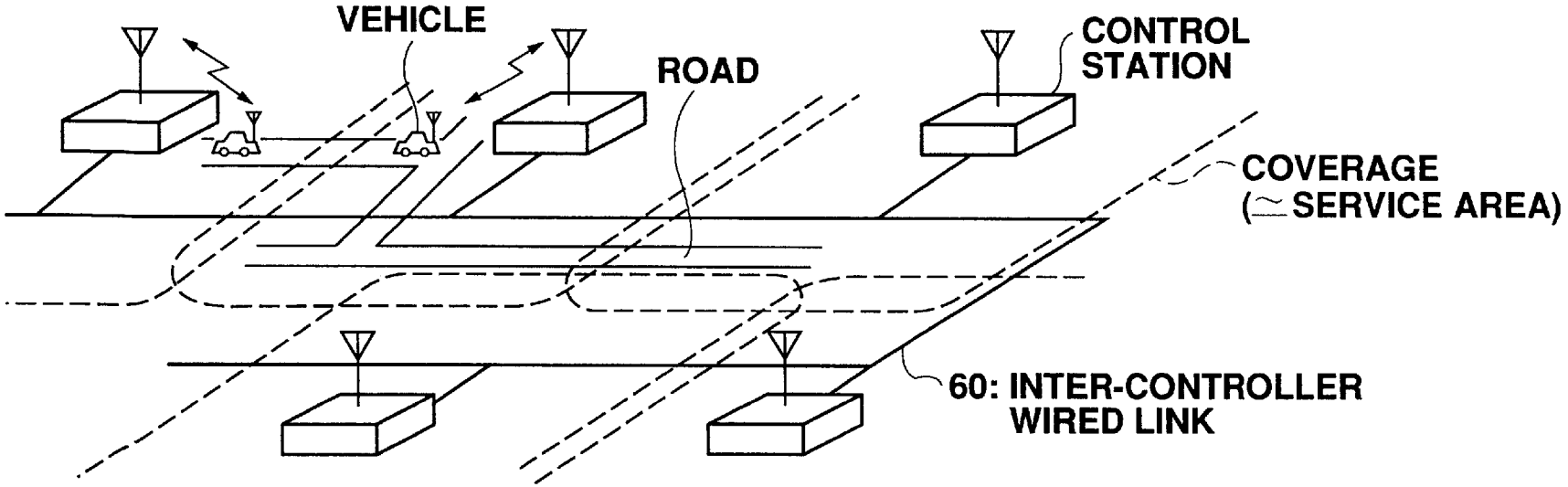
FIG. 12 shows a system configuration of an embodiment using radio control for vehicles traveling on roads.

Next, as shown in FIG. 12, control stations covering a certain tract of area (coverage) are provided. The present invention is applicable also to road traffic systems performing radio communications between vehicles and control stations instead of or together with vehicle—vehicle radio communications. In this case, it is possible to install in every vehicle a vehicle apparatus having a configuration identical to the vehicle apparatuses in the first through fourth embodiments shown in FIGS. 8 to 11 and to use the configuration (fifth embodiment) shown in FIG. 13 or the configuration (sixth embodiment) shown in FIG. 14 for the controller sets to be provided in the control stations.

Figure 13:
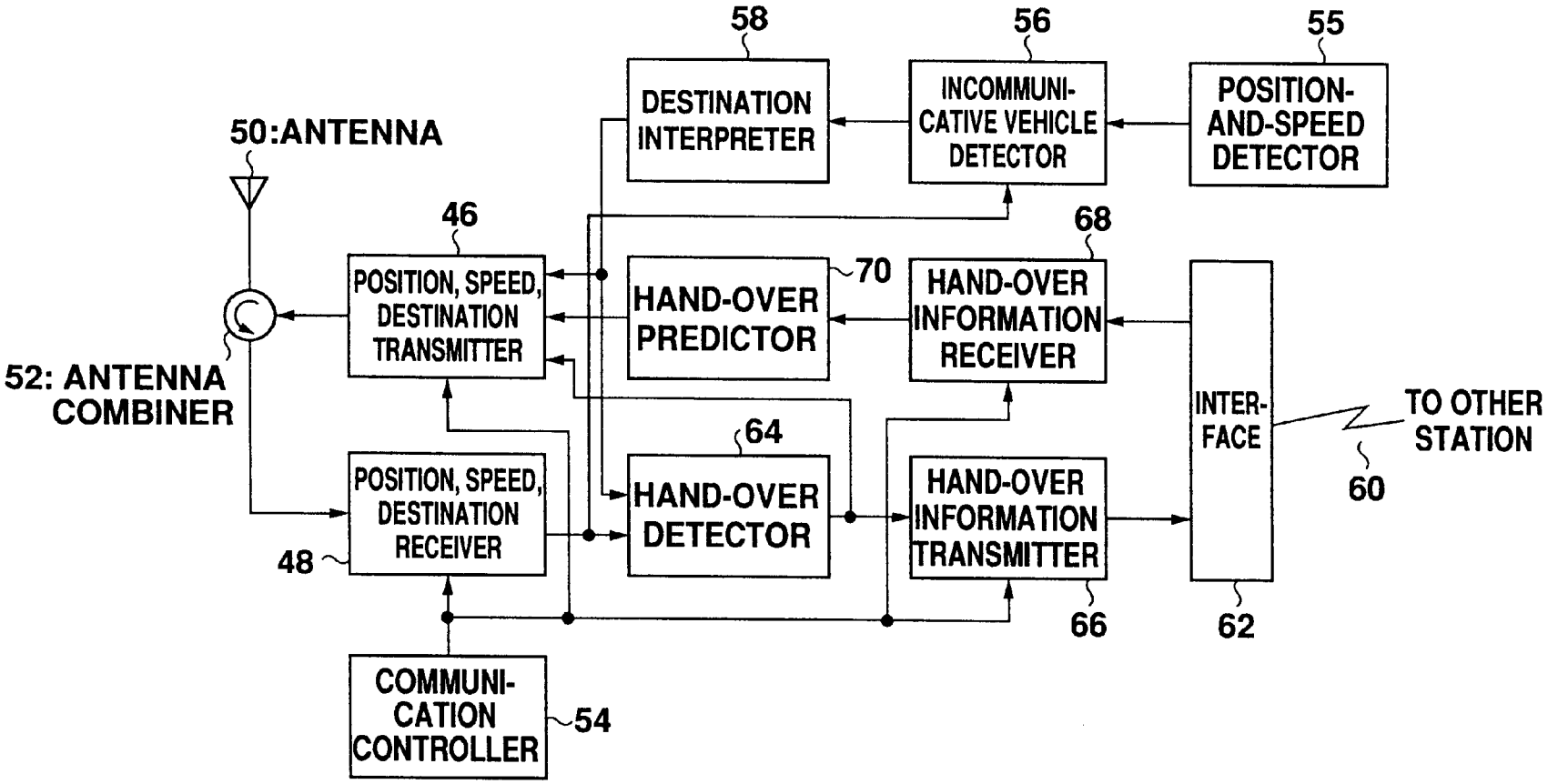
FIG. 13 is a functional block diagram of a controller set in the fifth embodiment of the present invention.

First, in the fifth embodiment, a vehicle apparatus having a configuration identical to the vehicle apparatuses in the first and/or second embodiments is installed into each vehicle, and the controller sets provided in the control stations have the configuration shown in FIG. 13. The controller set concerned with in this embodiment has a transmitter 46 and a receiver 48. The receiver 48 receives, over radio channels connecting the vehicles to the control station and by an antenna 50 via an antenna combiner 52, information that is transmitted from vehicles located within a service area (coverage) of the local control station. The received information is supplied via a detector 64 to the transmitter 46 and transmitted by the transmitter 46 via the antenna combiner 52 and the antenna 50 over controller-vehicle radio communication channels. A communication controller 54 controls the communication operations by the transmitter 46 and the receiver 48. Since the information that is transmitted by radio from each vehicle, namely, information regarding the destination, present position, and speed of each vehicle is retransmitted from the control station as a command, a plurality of vehicles within coverage of the same control station unable to directly communicate with each other by radio can each transmit and receive information regarding respective destinations, present locations, and speeds to each other, if the vehicles are distant from each other and thus the direct communication is impossible. The vehicle to vehicle radio channel and controller-vehicle radio channel may be implemented by a common (shared) channel or separate channels. The transmitter 10 and the receiver 12 of the vehicle apparatus in this embodiment may preferably access both channels.

The controller sets concerned with in this embodiment have a detector 55 for detecting, such as by cooperation with roadside positional sensors, the present positions and speeds of vehicles located within the coverage of the local control station. An incommunicative vehicle detector 56 compares the present positions of vehicles detected by the detector 55 with the present positions of vehicles received by the receiver 48 to specify communicative vehicles, located within the coverage of the local control station, that are not presently using the controller-vehicle radio channel, such as vehicles not equipped with vehicle apparatuses or vehicles equipped with non-operating vehicle apparatuses. The positions and speeds of incommunicative vehicles are supplied from the detector 55 to a destination interpreter 58 via the detector 56. The destination interpreter 58 estimates the future movement of the vehicle by monitoring the position of the specified vehicle in a time series and/or the speed of the vehicle. The result is information indicating the destination of the vehicle, which is supplied to the transmitter 46. The transmitter 46 transmits this information together with information from the receiver 48 onto the controller-vehicle radio communication channel, and the receivers 12 of the vehicle apparatus receives this information and supplies it to the course vector generator 22 and so forth. Therefore, in this embodiment, the vehicular traffic within the service area can be controlled and optimized while also taking into account the movements of vehicles not transmitting their destinations, present locations, speeds, and so forth.

Furthermore, the controller set concerned with in this embodiment has an interface 62 for connecting to an inter-controller wired link 60 shown in FIG. 12. On the other hand, a hand-over detector 64 detects, among vehicles presently located within the coverage of the local control station, vehicles about to enter the coverage of another control station in the near future on the basis of the information received by the receiver 48 and the information obtained by the detector 55 to the destination interpreter 58. A transmitter 66 transmits information regarding the vehicles detected by the hand-over detector 64 to the inter-controller wired link 60 via the interface 62 as hand-over information to the other control station. As hand-over information, information specifying the area to be exited or the control station (local control station) covering this area, information specifying the area to be entered or the control station covering this area, the destination, present position, and speed of the entering vehicle, or based on these the estimated hand-over time are transmitted. A receiver 68 receives via the interface 62 the hand-over information transmitted over the inter-controller wired link 60 from the transmitter 66 of the other control station, and a hand-over predictor 70 detects the vehicles about to enter the coverage of the local control station based on the received hand-over information. On the basis of the hand-over information concerning the detected vehicles, the hand-over predictor 70 generates information regarding the destination, present position, and speed of the vehicles, and the transmitter 46 transmits this information together with the above-mentioned information. The receiver 12 of the vehicle apparatus receives this and supplies it to the course vector generator 22 and so forth. Therefore, in this embodiment, the vehicular traffic within the service area can be controlled and optimized while also taking into account the movements of vehicles located in an area different from the area in which the local vehicle is located.

The communication controller 54 also controls the communication operations by the transmitter 66 and the receiver 68. In the arrangement of control stations shown in FIG. 12, there are areas redundantly covered by a plurality of control stations. The authority to control of the vehicles located in these boundary areas can be granted to one of the bordering control stations by the vehicle depending to the radio reception conditions, can be granted by the vehicle so as to maximize the length of control by the same control station, or can be transferred between the control stations by referring to at the hand-over time in the hand-over information.

Figure 14:
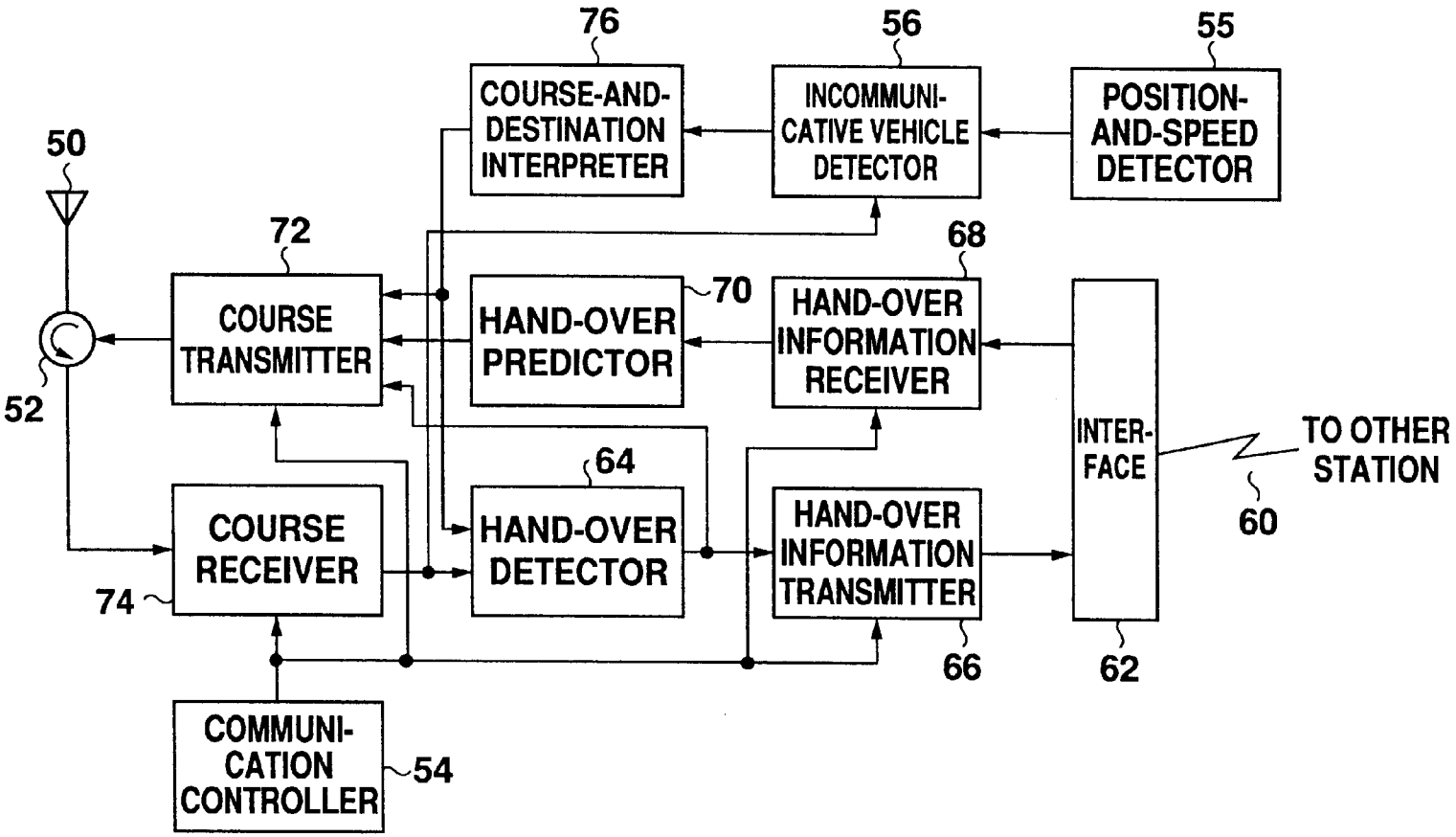
FIG. 14 is a functional block diagram of the controller set in the sixth embodiment of the present invention.

Next, in the sixth embodiment, a vehicle apparatus having a configuration identical to the vehicle apparatuses in the first and/or second embodiments is installed into every vehicle, and the controller sets provided in the control stations have the configuration shown in FIG. 14. The controller set concerned with in this embodiment has a transmitter 72 and a receiver 74. Although the functions of the transmitter 72 and the receiver 74 are substantially identical to those of the transmitter 46 and the receiver 48 in the fifth embodiment, the difference is the transmitted and received information, as a command, indicates the course of the vehicles. Except for estimating not only the destination but also the course, the function of a course-and-destination interpreter 76 is identical to that of the destination interpreter 58. The functions of the other members are also identical to those of the corresponding members of the fifth embodiment, except that the information to be handled includes information regarding the course. The communication controller 54 controls the communication operations of the transmitters 66 and 72, and the receivers 68 and 74. Therefore, this embodiment enjoys the same advantages of the fifth embodiment in the system performing radio communication of course information. Furthermore, since hand-over information including course information is transmitted and received, a command regarding the course to be taken by a vehicle, presently located within the coverage (to be exited) of the control station, into a coverage (to be entered) of another control station is decided by the control station of which coverage area is to be exited, the result is sent to the control station of which coverage area is to be entered as part of hand-over information, the presence or absence of course conflicts for vehicles located within a coverage area of the control station to be entered is determined by the control station to be entered or the vehicles located in the coverage area, and the result is fed back to the control station to be exited, so that the course (command) can be coordinated.

Figure 15:
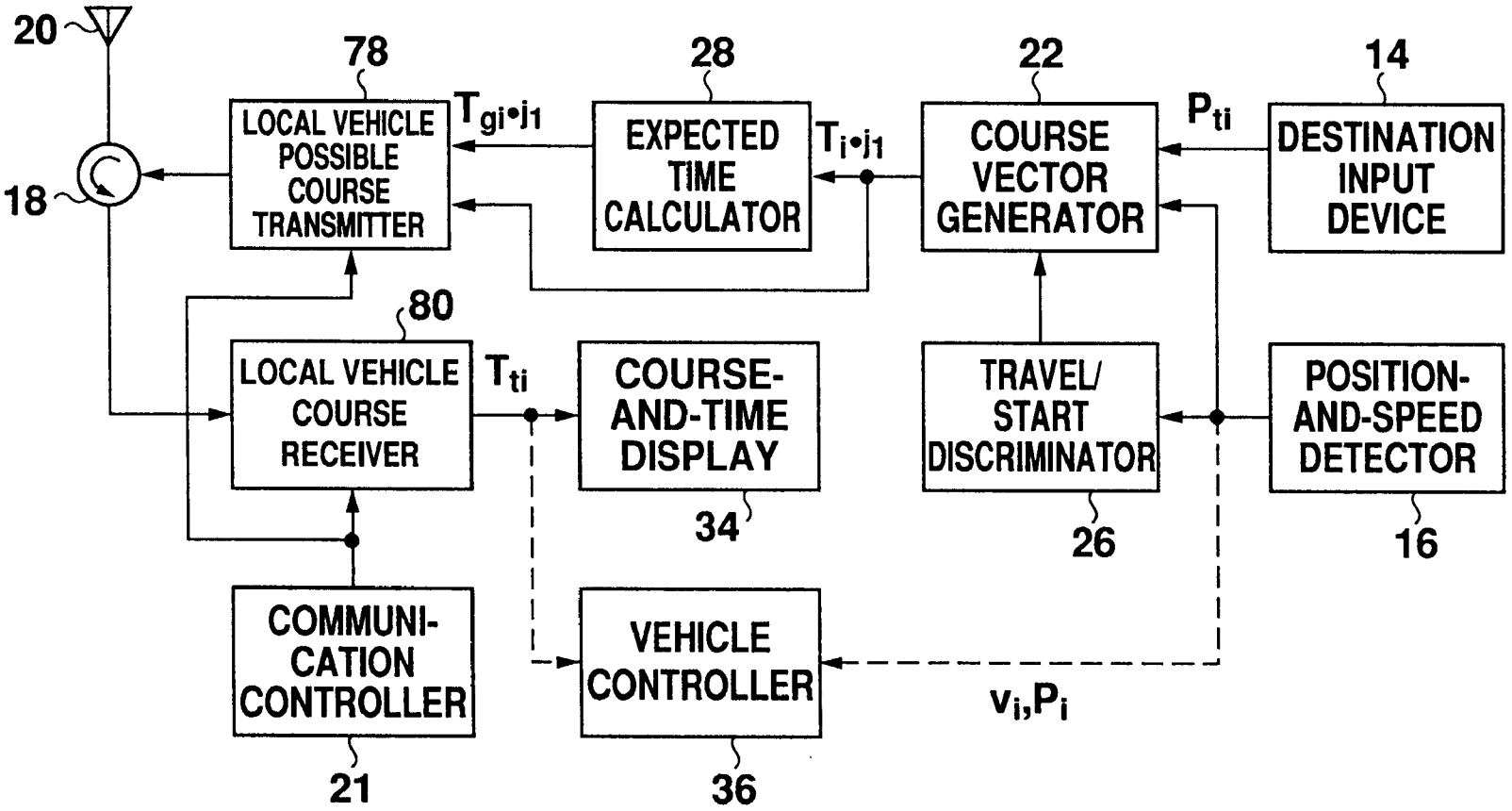
FIG. 15 is a functional block diagram of the mobile set in the seventh embodiment of the present invention.
Figure 16:
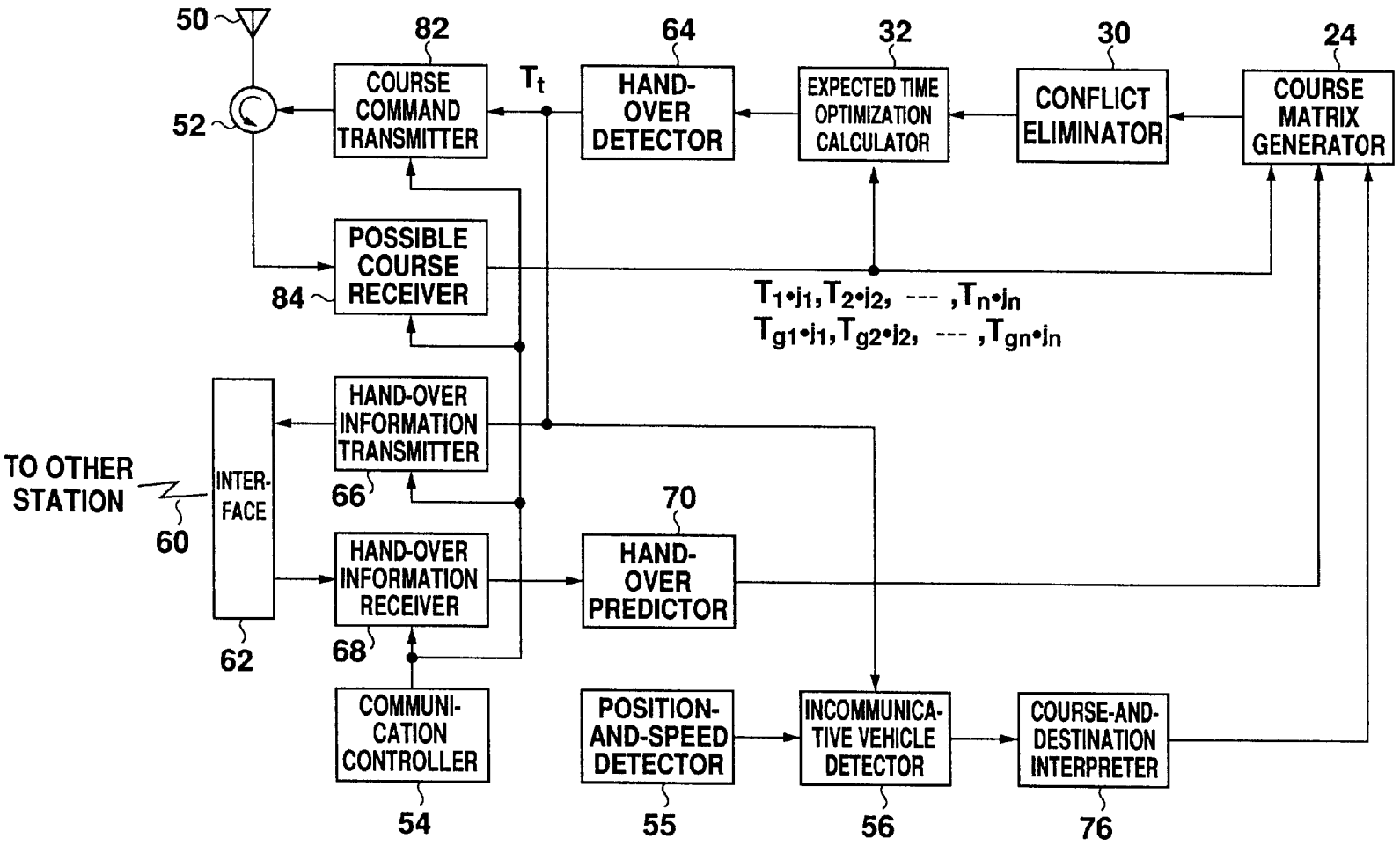
FIG. 16 is a functional block diagram of the controller set in the eighth embodiment of the present invention.

The seventh embodiment is provided with the control station performing the processes subsequent to the course matrix generation among the calculation functions provided in the vehicle apparatuses in the fifth and sixth embodiments. The vehicle apparatus installed in each vehicle has the configuration shown in FIG. 15, and the controller set provided in the control station has the configuration shown in FIG. 16. In this embodiment, the communication controller 21 controls the operation of a transmitter 78 for transmitting the information obtained by the course vector generator 22 and the expected time calculator 28, namely, information regarding possible courses of the local vehicle, and the operation of a receiver 80 for receiving the information determined at the control station, namely, information (command) regarding the course of the local vehicle. The communication controller 54 controls the operation of a transmitter 82 for transmitting the information obtained by the course matrix generator 24 to the expected time optimization calculator 32, namely, information regarding the course to be taken by the vehicle located within the coverage of the local control station, and the operation of a receiver 84 for receiving the information transmitted from each vehicle, namely, information regarding possible courses for the respective vehicles. This lightens the load of the calculation processing at each vehicle.

Figure 18:
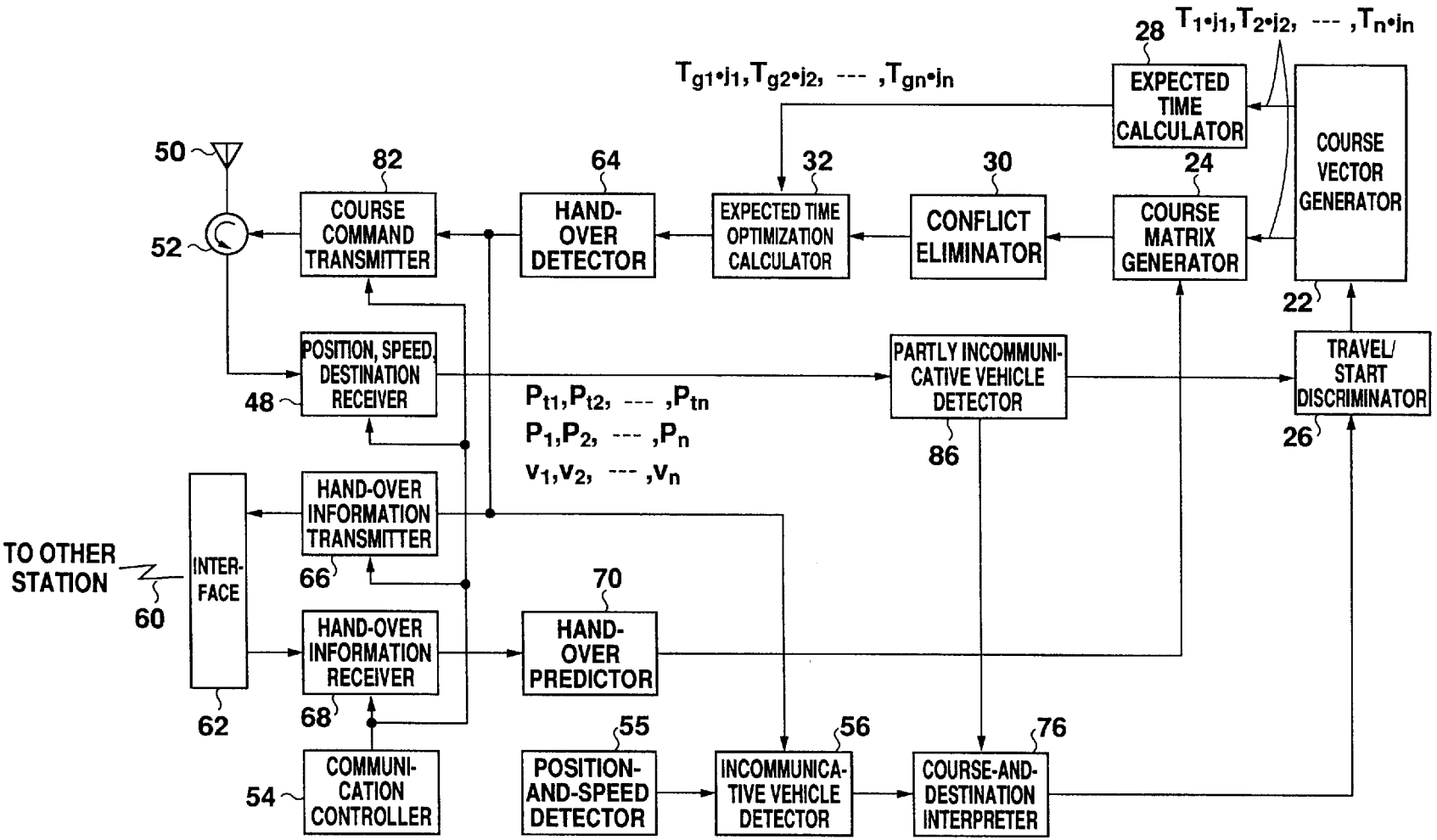
FIG. 18 is a functional block diagram of the controller set in the ninth embodiment of the present invention.
Figure 19:
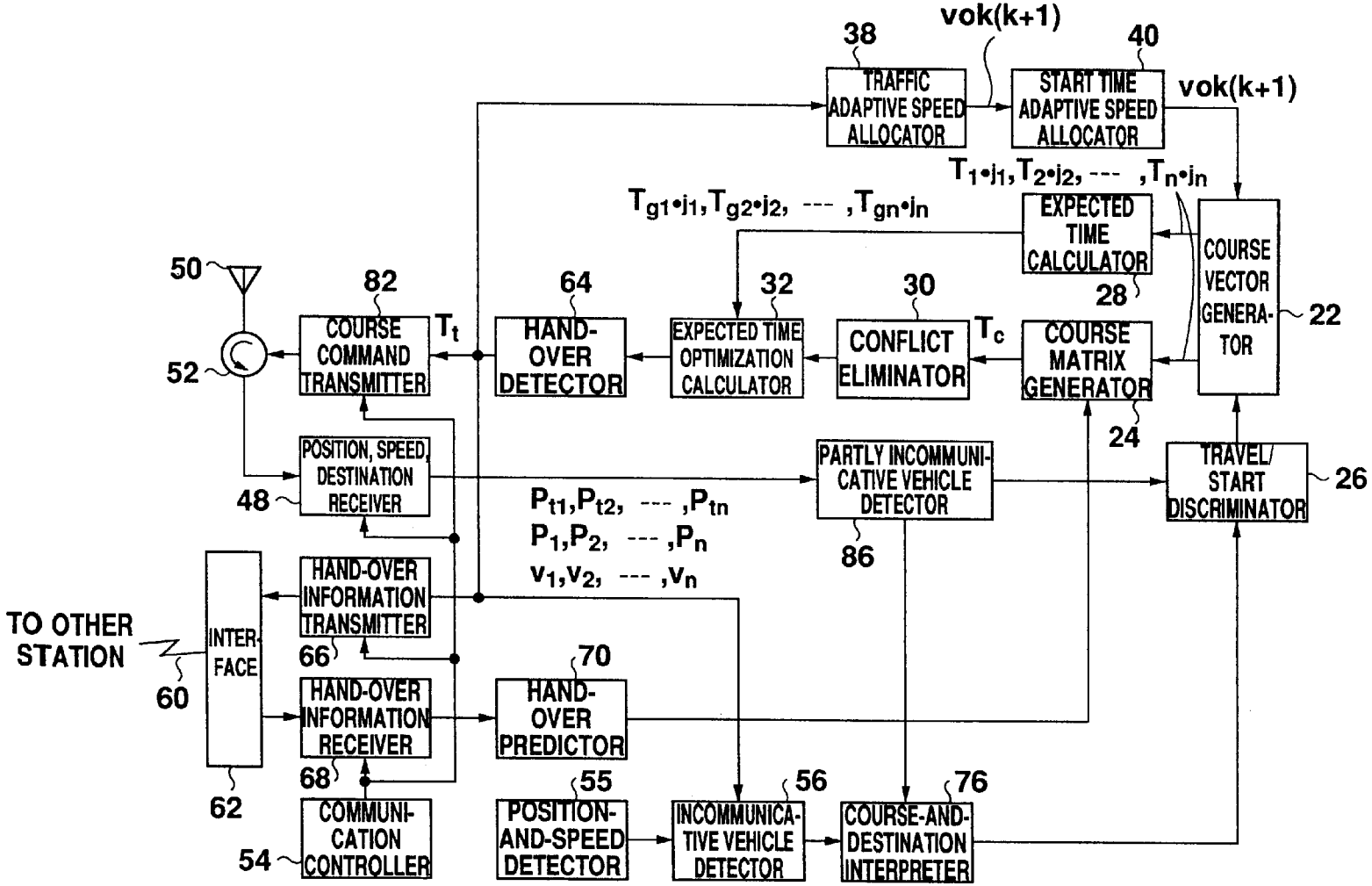
FIG. 19 is a functional block diagram of the controller set in the tenth embodiment of the present invention.

The eighth embodiment is provided with the control station performing the calculation functions provided in the vehicle apparatuses in the fifth and sixth embodiments except the processes relating to destination input and detection of the present position and speed of the local vehicle. The ninth embodiment further provides the traffic adaptive speed allocator 38 and the start time adaptive speed allocator 40 to the controller set, in addition to the functions of the eighth embodiment. In these embodiments, a vehicle apparatus having the configuration shown in FIG. 17, for example, is installed in each vehicle. Controller sets having the configurations shown in FIG. 18 and FIG. 19 are provided in the control stations in the eighth embodiment and the ninth embodiment, respectively. Thus, the configuration of the vehicle apparatuses can be simplified by providing a large portion of the calculation processing, which determines the courses, at the controller sets.

The eighth and ninth embodiments also are provided with a partly communicative vehicle detector 86 in the controller set. On the basis of information received by the receiver 48, the partly communicative vehicle detector 86 extracts the vehicles transmitting information regarding their destinations and not transmitting information regarding their present position and speed, namely, incommunicative vehicles. This type of vehicle uses controller-vehicle radio communication channels for its destination so that in the incommunicative vehicle detector 56, vehicles are extracted as communicative vehicles using controller-vehicle radio communication channels. On the basis of the present position and speed detected by the detector 55 and the destination received by the receiver 48, the course-and-destination interpreter 76 estimates the course for the partly communicative vehicle detected by the detector 86 among communicative vehicles detected by the detector 56. This estimated result is supplied to the course vector generator 22.

Figure 17:
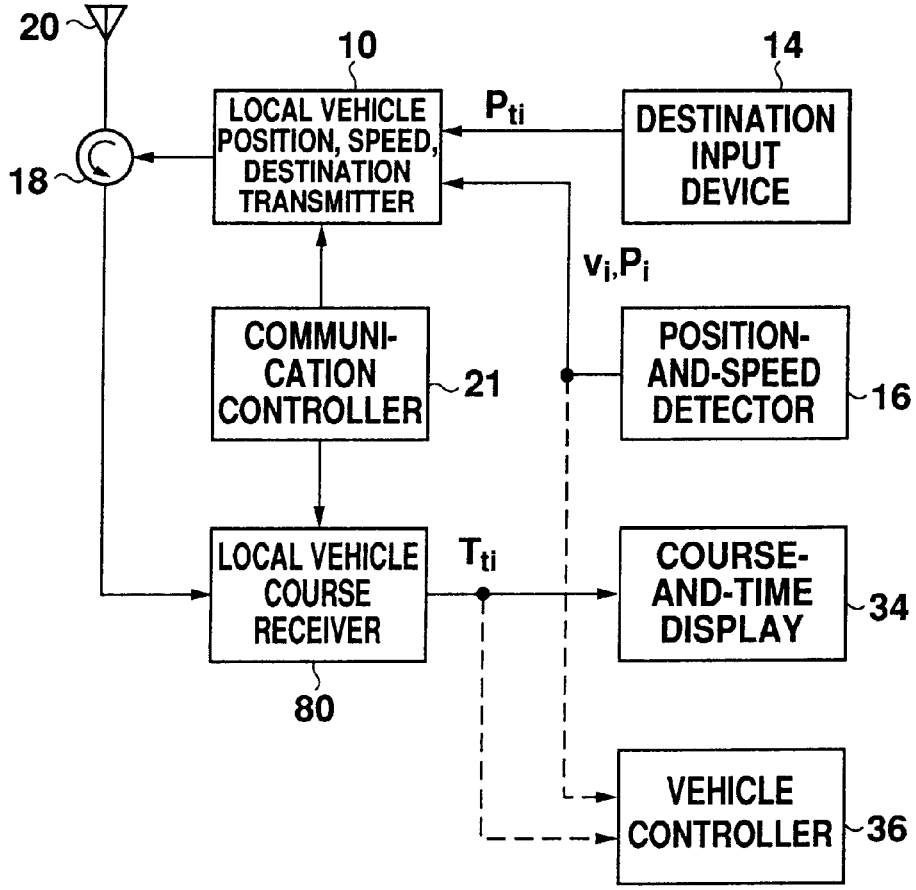
FIG. 17 is a functional block diagram of the mobile set in the ninth and tenth embodiments of the present invention.
Figure 20:
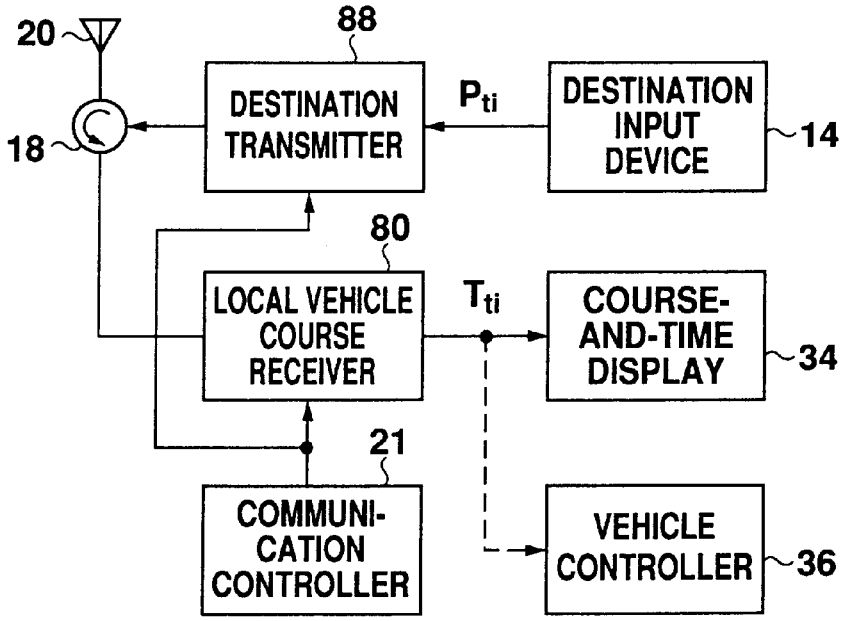
FIG. 20 is a functional block diagram of another example of the mobile set in the ninth and tenth embodiments of the present invention.
Figure 21:
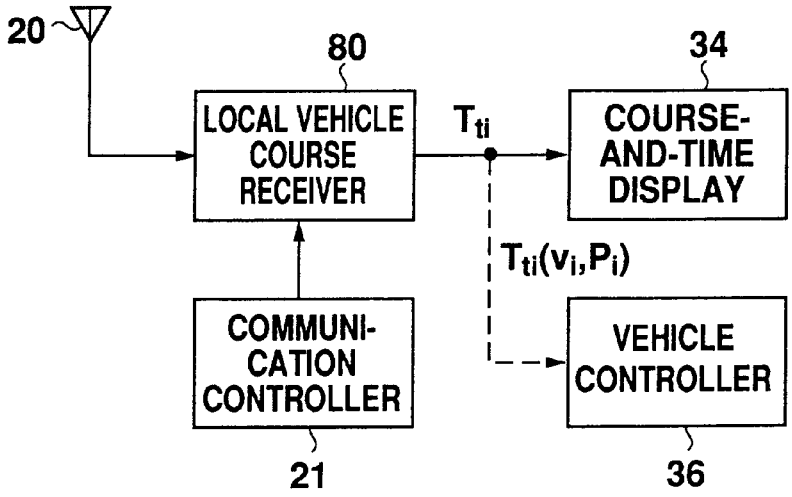
FIG. 21 is a functional block diagram of another example of the mobile set in the ninth and tenth embodiments of the present invention.

Therefore, in the eighth and ninth embodiments, it is possible to simplify the configuration of the vehicle apparatus as compared to the configuration shown in FIG. 17. For example, as shown in FIG. 20, it is possible to obviate the detector 16 from the configuration shown in FIG. 17, and further to provide a transmitter 88 to replace the transmitter 10. Under control of the communication controller 21, the transmitter 88 transmits information regarding destination that is input through the destination input device 14 to the control station. This type of configuration can be adopted since partly communicative vehicles are extracted at the controller set and their courses are estimated. Furthermore, as shown in FIG. 21, it is possible to adopt a configuration obviating the destination input device 14 and the transmitter 88. The use of a vehicle apparatus having this sort of simplified configuration is possible since incommunicative vehicles are extracted and their courses are estimated at each controller set. Therefore, it is possible to further simplify the configuration of the vehicle apparatus in the eighth and ninth embodiments.

(5) Embodiments concerning tracked vehicle traffic systems

Figure 22:
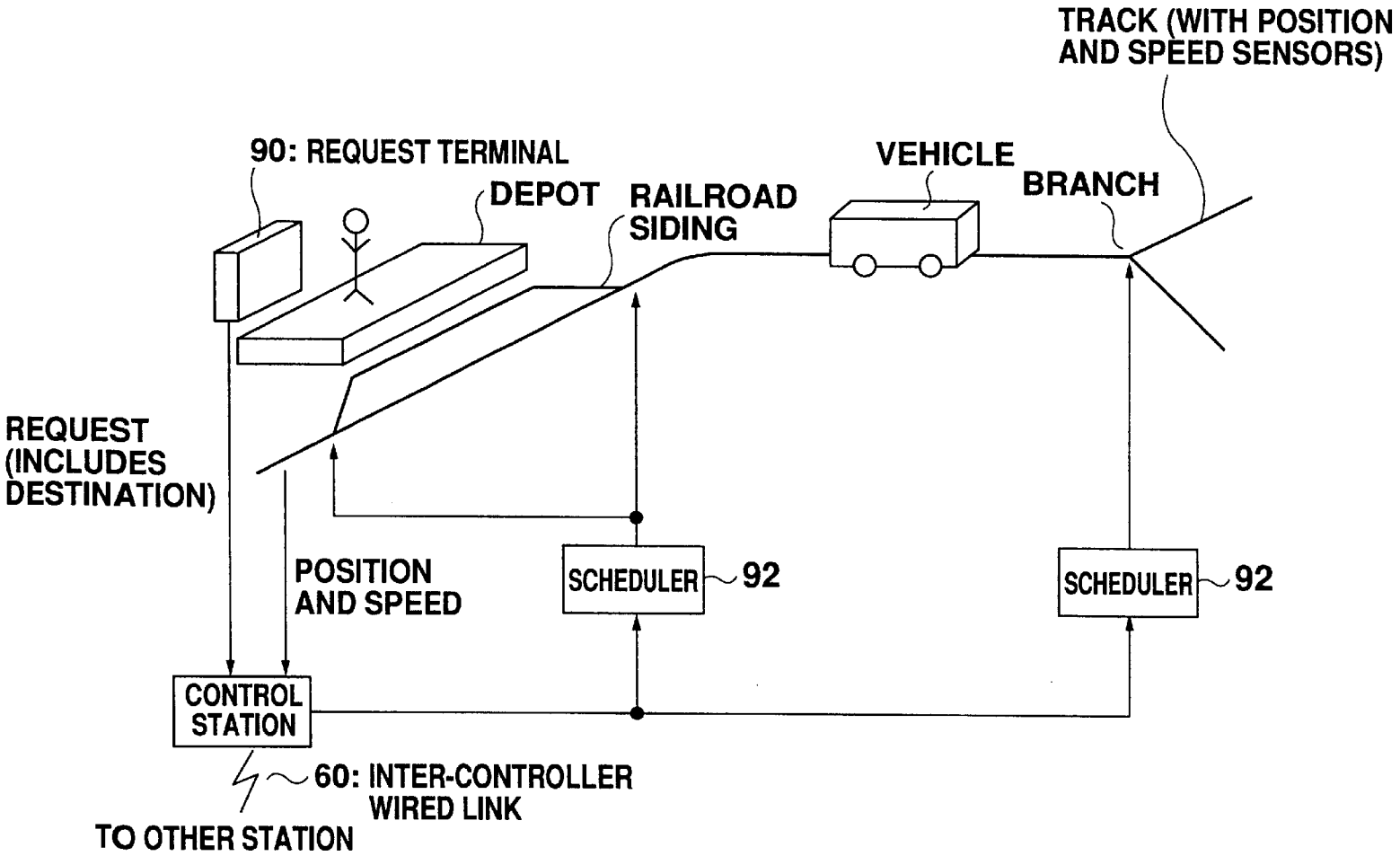
FIG. 22 shows a system configuration of an embodiment in a tracked traffic system.
Figure 23:
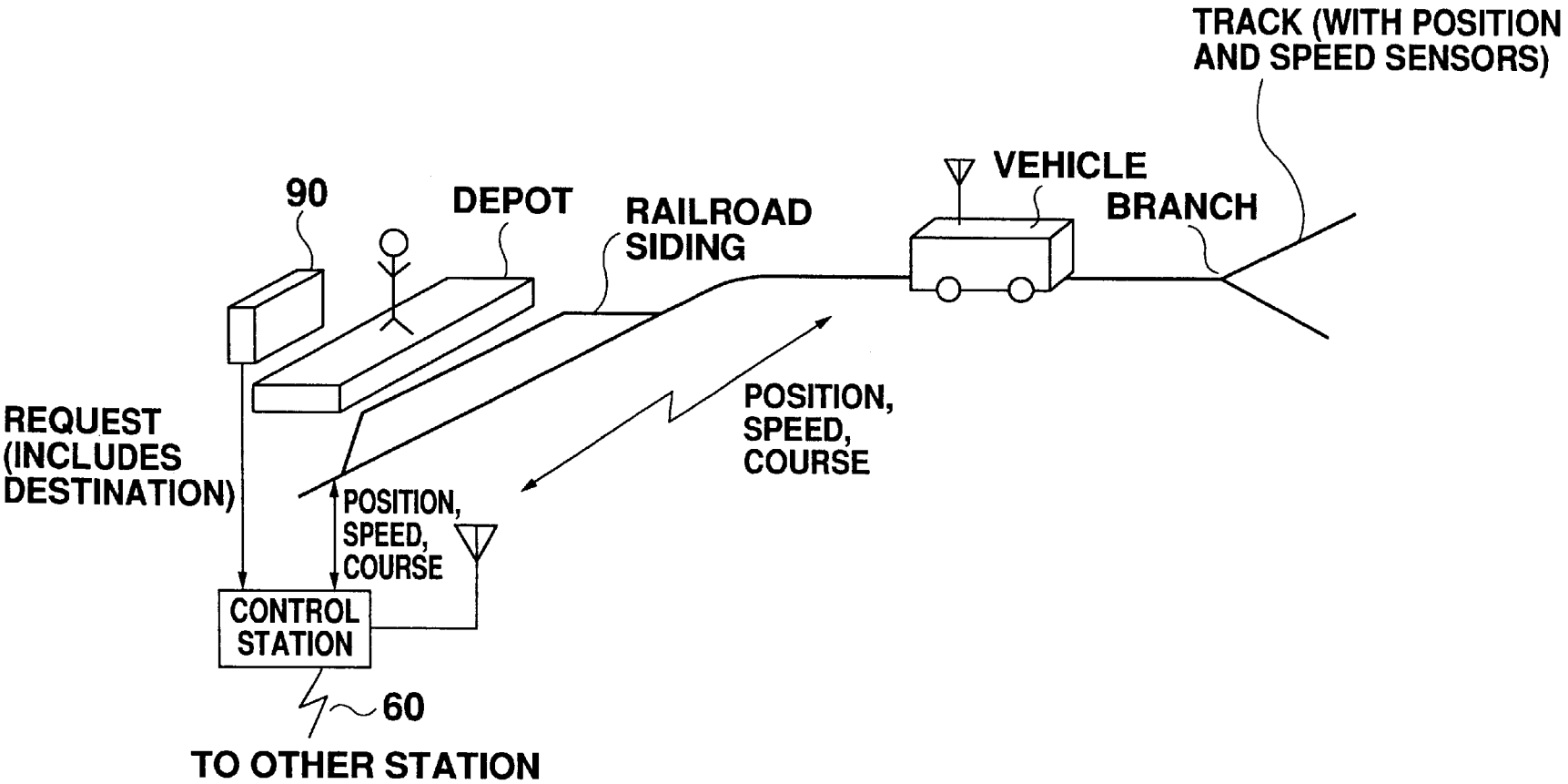
FIG. 23 shows a another example of a system configuration of an embodiment in the tracked traffic system.

Furthermore, the present invention can be also applied to tracked vehicle traffic systems in which vehicles travel on tracks. In this case, example configurations of such an overall system are shown in FIG. 22 (tenth embodiment) and in FIG. 23 (eleventh embodiment). In these embodiments, the vehicles travel on tracks having branches to various locations. Furthermore, depots are provided along the sidings of these tracks. Additionally, each depot is provided with a request terminal 90 for a user to request a vehicle. The request terminal 90 is connected to the control station (more specifically the controller set) via wires or radio channels.

In the tenth embodiment shown in FIG. 22, the controller set programs and registers the crossing times of vehicles and information specifying crossing vehicles in a scheduler 92 at each branch point according to requests from the request terminal 90, and according to the program each scheduler 92 controls the operation of the corresponding branch point. In the eleventh embodiment shown in FIG. 23, the control station 60 commands the course to each vehicle according to requests from the request terminal 90. Each controller set detects the present position and speed of each vehicle using the position and speed sensors provided along the tracks or the radio communications with each vehicle.

Figure 24:
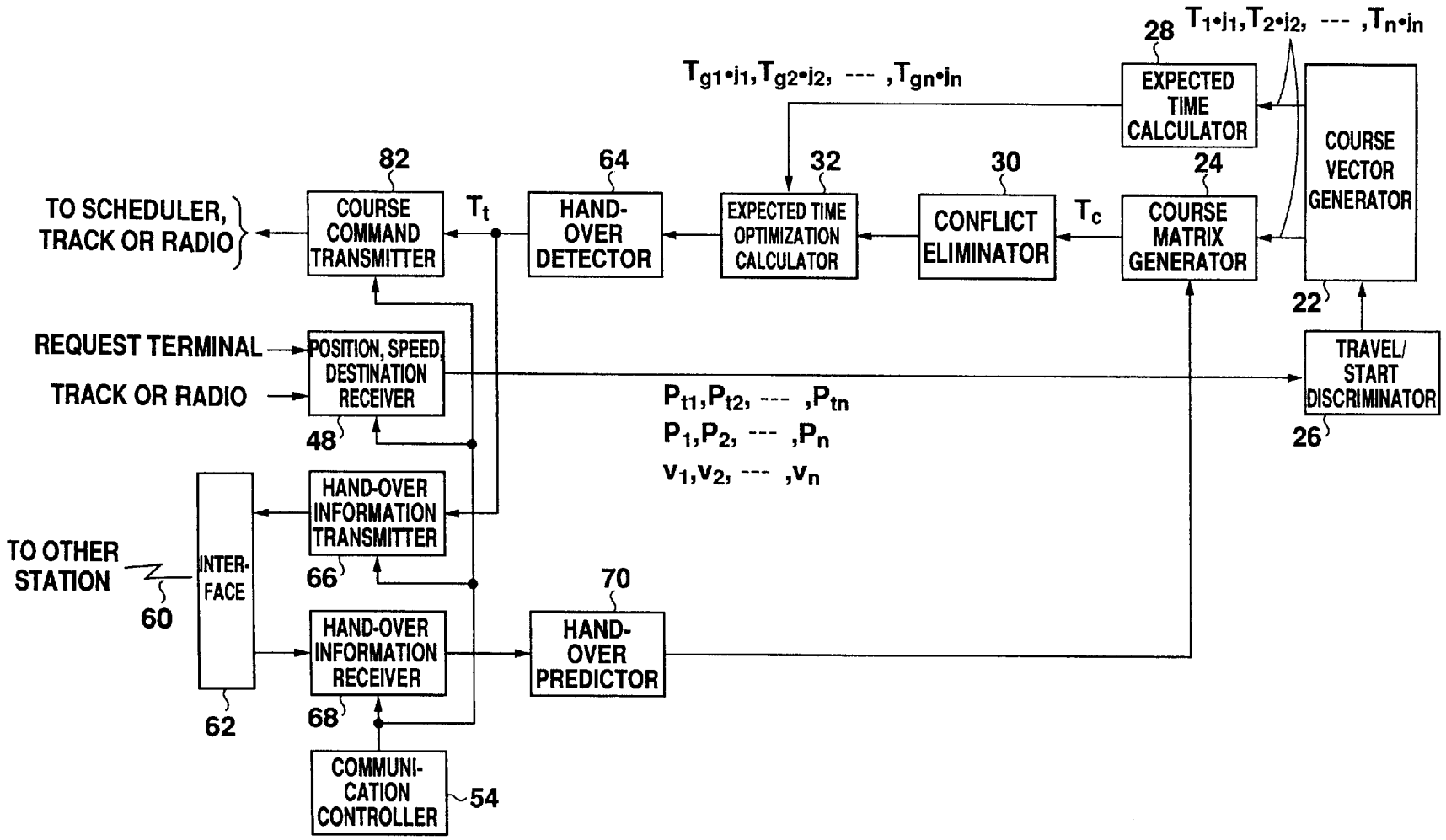
FIG. 24 is a functional block diagram of the controller set in the eleventh and twelfth embodiments of the present invention.
Figure 25:
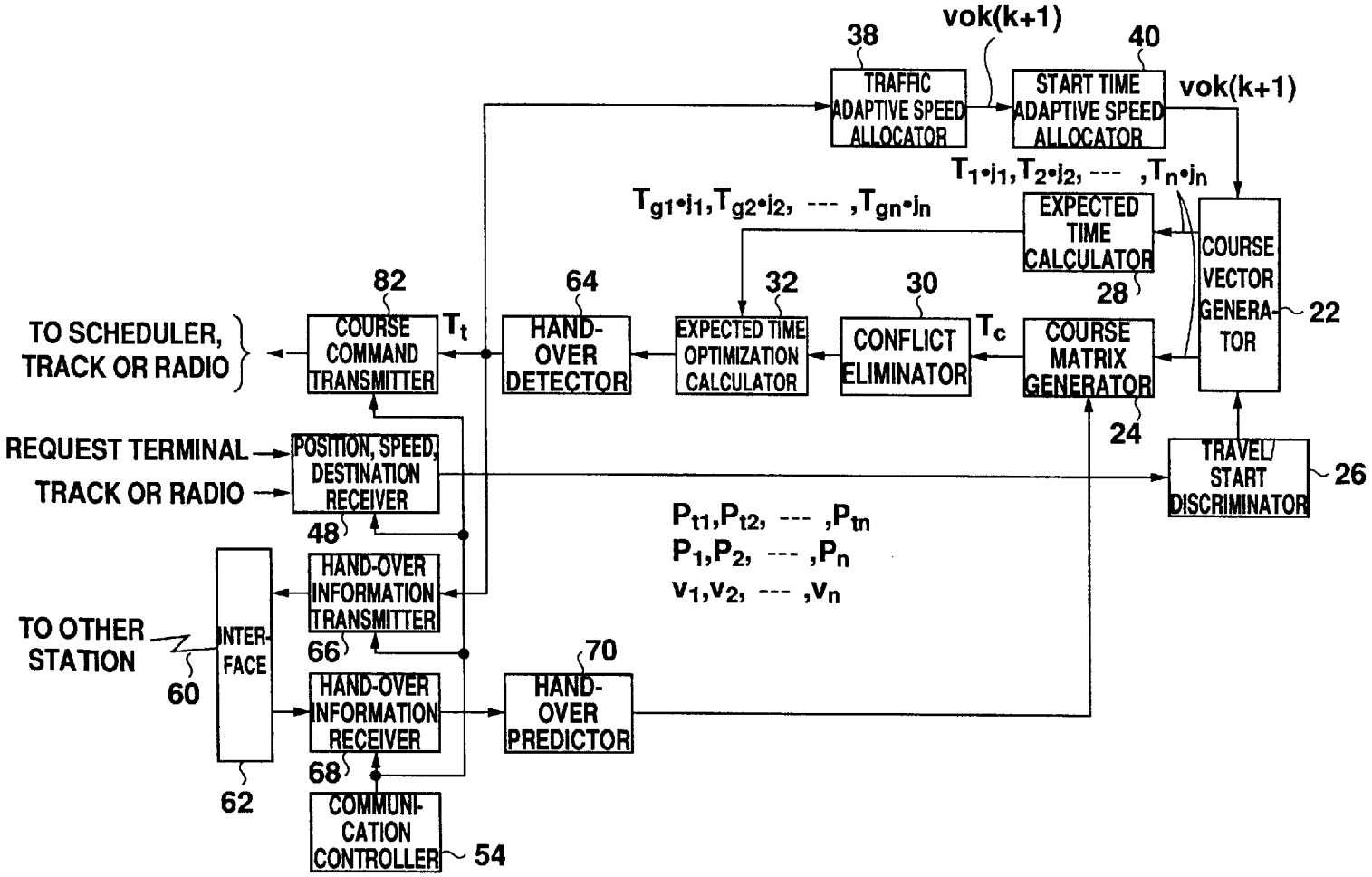
FIG. 25 is a functional block diagram of another example of the controller set in the eleventh and twelfth embodiments of the present invention.

FIGS. 24 and 25 respectively show the configurations of the usable controller sets in the tenth and eleventh embodiments. As shown in these figures, the controller sets in the tenth and eleventh embodiments can have configurations substantially identical to the controller sets in the eighth and ninth embodiments. However, for adaptation to the tracked traffic system, modifications are required for the apparatus to command courses to respective vehicles, for the process to input the present position and speed of each vehicle, and for the process to receive the destination of each vehicle.

(6) Supplement

In the preceding description, applicable traffic systems were described for an embodiment which is a pure road traffic system and an embodiment which is a pure tracked traffic system. However, the present invention can also be embodied in a form for controlling the traffic of both vehicles on roads and vehicles on tracks in a traffic system in which roads and tracks are combined. Furthermore, the present invention is also applicable to systems for guiding people or vehicles, such as within buildings having complex corridors and passageways. Although radio waves were used in the embodiments for radio communications between vehicles and between vehicles and control stations, other carriers, such as light, may be used if feasible. Also, although controller-vehicle radio communications were performed in the embodiments by providing an antenna at the control station, a number of items of radio equipment may be arranged along the roads or tracks and connected by radio or wires to the control station. The radio equipment can be implemented using signposts or leakage coaxial cables. Furthermore, although embodiments were given in which a plurality of control stations were provided, one-control-station system is sufficient to apply the present invention. Communications between control stations may use not wires but radio channels. Also, although a display device was used as a means to provide course information to the vehicle passengers, an audio output device or speech synthesis device may be used. Furthermore, although it was assumed that matrix Tc always exists so that course conflicts do not occur at the intersections, if such a matrix T, does not exist, a procedure to select a matrix Tc having a low incidence of course conflicts may be included. The incidence of course conflicts can be evaluated from the number of intersections where course conflicts occur, the number of vehicles involved in the course conflicts, and so forth. Also, a matrix $T_c$ having the smallest number of vehicles in the vicinity of the intersection where course conflicts occur may be selected.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A vehicle traffic control system covering an area in which a plurality of vehicles travel along a plurality of roads and/or tracks which intersect at various locations, comprising:

a possible course determination apparatus for generating course settings each of which is a combination of one vehicle's possible course and other vehicles' possible courses which may be taken in the future in said area and for determining possible course patterns of said course settings;

a course determination apparatus for selecting possible course patterns with less conflict, said conflict being defined as a phenomenon that one vehicle's course crosses another vehicle's course at a common intersection at substantially the same time, and for determining one of the selected possible course patterns as a course pattern, said course pattern comprising course settings to be taken by the vehicles located within said area to avoid conflict;

a position detection apparatus for detecting present positions of vehicles, including a vehicle-under-control, by devices installed on said vehicles or provided externally of said vehicles, said vehicle-under-control being a vehicle located within said area and yielding to said course pattern determined by said course determination apparatus;

a destination detection apparatus detecting destinations for vehicles, including said vehicle-under-control, through input by passengers of the vehicles or through estimation based on movements of the vehicles; and a course calculation apparatus determining courses of vehicles, including said vehicle-under-control, on the basis of detected present positions and destinations and speeds to be adopted on respective roads and/or tracks, wherein said possible course determination apparatus generates said course settings on the basis of the courses determined by said course calculation apparatus.

2. The vehicle traffic control system according to claim 1, further comprising at least one allocator selected from the following group:

a traffic adaptive speed allocator allocating said speeds to be adopted on respective roads and/or tracks so that a relatively high speed is assigned to a road or a track for which traffic is predicted to be relatively heavy when respective vehicles in said area move according to said course pattern;

a start time adaptive individual speed allocator allocating said speeds to be adopted on respective roads and/or tracks so that a relatively high speed is assigned to a road or a track for which it is predicted that vehicles having relatively long start times pass in relatively high numbers when respective vehicles in said area move according to said course pattern; and a start time adaptive speed allocator allocating said speeds to be adopted on respective roads and/or tracks so that said speeds are uniformly increased in accordance with increasing a predicted average start time for vehicles waiting to start, said predicted average start time being calculated under the assumption that respective vehicles in said area move according to said course pattern.

3. The vehicle traffic control system according to claim 1, further comprising:

said position detection apparatus further detecting a present position for each vehicle-out-of-control, said vehicle-out-of-control being a vehicle located within said area and not yielding to said course pattern;

said destination detecting apparatus further detecting a destination for each vehicle-out-of-control, the destination of said vehicle-under-control being detected through input by a passenger of the vehicle-under-control or through estimation of the movement of the vehicle-under-control, the destination of said vehicle-out-of-control being detected through estimation of the movement of the vehicle-out-of-control; and said course calculation apparatus further determining courses of vehicles including said vehicle-out-of-control on the basis of detected present positions and destinations and said speeds to be adopted on respective roads and/or tracks;

wherein said possible course determination apparatus generates said course settings on the basis of the courses of both said vehicle-under-control and said vehicle-out-of-control.

4. The vehicle traffic control system according to claim 1, further comprising:

a hand-over vehicle count apparatus inputting information indicating possible courses of each vehicle which is predicted to enter said area in the near future, wherein said possible course determination apparatus generates said course settings on the basis of the possible courses of both said vehicle-under-control and said entering vehicle.

5. The vehicle traffic control system according to claim 4, further comprising:

a controller-controller communication channel for connecting a control station covering said area and another control station covering another area, wherein said hand-over vehicle count apparatus inputs from said another control station said information indicating said possible courses of each entering vehicle, and supplies to said another control station information indicating possible courses of each exiting vehicle which is predicted to exit said area, via said controller-controller communication channel.

6. The vehicle traffic control system according to claim 1, further comprising:

a vehicle—vehicle communication channel for connecting vehicles-under-control to each other, wherein each of said vehicles-under-control has a combination apparatus comprising said position detection apparatus, said destination detection apparatus, said course calculation apparatus, said possible course determination apparatus and said course determination apparatus, wherein each of said vehicles-under-control receives information from other vehicles-under-control via said vehicle—vehicle communication channel, operates said combination apparatus on the basis of the information from other vehicles-under-control, and transmits information obtained in processing by said combination apparatus to other vehicles-under-control via said vehicle—vehicle communication channel.

7. The vehicle traffic control system according to claim 1, further comprising:

a controller-vehicle communication channel for connecting a control station covering said area and vehicles-under-control, wherein each of said vehicles-under-control has a first partial processing apparatus, said control station has a second partial processing apparatus, and said first and second partial apparatuses provide, through connection via said controller-vehicle communication channel, a combination apparatus comprising said position detection apparatus, said destination detection apparatus, said course calculation apparatus, said possible course determination apparatus and said course determination apparatus, wherein each of said vehicles-under-control receives information from said control station via said controller-vehicle communication channel, operates said first partial processing apparatus on the basis of the information from said control station, and transmits information obtained in processing by said first partial processing apparatus to said control station via said controller-vehicle communication channel, wherein said control station receives information from said vehicles-under-control via said controller-vehicle communication channel, operates said second partial processing apparatus on the basis of the information from said vehicles-under-control, and transmits information obtained in processing by said second partial processing apparatus to said vehicles-under-control via said controller-vehicle communication channel.

8. The vehicle traffic control system according to claim 1, further comprising:

tracks for vehicles to move along, said tracks being disposed within said area;

depots for users to get on and off said vehicles, said depots being disposed along said tracks and being provided with facilities for the users to issue requests concerning vehicle allocation;

at least one scheduler, each scheduler controlling branching and linking operations of said tracks and being disposed at a corresponding intersection of said tracks; and a control station covering said area and having a combination apparatus comprising said position detection apparatus, said destination detection apparatus, said course calculation apparatus, said possible course determination apparatus and said course determination apparatus, said control station, in response to users' requests, operating said combination apparatus and commanding each scheduler to control the corresponding intersection in accordance with said course pattern determined by said combination apparatus.

9. The vehicle traffic control system according to claim 1, further comprising:

tracks for vehicles to move along, said tracks being disposed within said area;

depots for users to get on and off said vehicles, said depots being disposed along said tracks and being provided with facilities for the users to issue requests concerning vehicle allocation; and a control station covering said area and having a combination apparatus comprising said position detection apparatus, said destination detection apparatus, said course calculation apparatus, said possible course determination apparatus and said course determination apparatus, said control station, in response to users'requests, operating said combination apparatus and commanding each vehicle to move in accordance with said course pattern determined by said combination apparatus.

10. A vehicle traffic control system covering an area in which a plurality of vehicles travel along a plurality of roads and/or tracks which intersect at various locations, comprising:

a possible course determination apparatus for generating a plurality of course setting course settings each of which is a combination of one vehicle's possible course and other vehicles' possible courses which may be taken in the future in said area and for determining a plurality of setting possible course patterns of said course settings; and a course determination apparatus for selecting possible course patterns with less conflict, said conflict being defined as a phenomenon that one vehicle's course crosses another vehicle's course at a common intersection at substantially the same time, and for determining one of the selected possible course patterns as a course pattern, said course pattern comprising course settings to be taken by the vehicles located within said area to avoid conflict.

11. The vehicle traffic control system according to claim 10, further comprising:

an average expected time discriminator for calculating an average of expected times for vehicles located within said area to reach their respective destinations from their respective present positions for each of said possible course patterns with less conflict, wherein said course determination apparatus determines said course pattern by selecting a possible course pattern having a relatively small average of expected times.

12. The vehicle traffic control system according to claim 10, wherein said vehicles include at least one vehicle-under-control, the system further comprising:

a start time determination apparatus for determining a time until start for each possible course pattern and for each vehicle-under-control waiting to be started so that said conflict does not occur for any other vehicles at any intersection, said vehicle-under-control being a vehicle located within said area and yielding to the course pattern determined by said course determination apparatus.

13. A vehicle traffic control method implemented in an area in which a plurality of vehicles travel along a plurality of roads and/or tracks which intersect at various locations, said vehicle traffic control method comprising the steps of:

generating a plurality of course settings each of which is a combination of one vehicle's possible course and other vehicles' possible courses which may be taken in the future in said area;

determining a plurality of said course settings as possible course patterns;

selecting possible course patterns with less conflict, said conflict being defined as a phenomenon that one vehicle's course crosses another vehicle's course at a common intersection at substantially the same time; and further selecting one of the selected possible course patterns as a course pattern, said course pattern comprising course settings to be taken by the vehicles located within said area to avoid conflict.

14. A vehicle apparatus installed in a vehicle and used in a vehicle traffic control system, comprising:

a position detection apparatus for detecting present positions of vehicles including a vehicle-under-control, said vehicle-under-control being a vehicle yielding to a determined course pattern and being located within an area in which a plurality of vehicles including said vehicle-under-control travel along roads and/or tracks intersecting at various locations;

a destination detection apparatus for detecting destinations of vehicles including said vehicle-under-control, through input by the vehicles' passengers or through estimation based on movements of said vehicles;

a course calculation apparatus for calculating possible courses of vehicles including said vehicle-under-control, on the basis of detected present positions and destinations of the vehicles and speeds to be adopted on respective roads and/or tracks;

a possible course determination apparatus for generating, by using the possible courses calculated by said course calculation apparatus, course settings each of which is a combination of one vehicle's possible course and other vehicles' possible courses which may be taken in the future in said area and for determining possible course patterns of said course settings; and a course determination apparatus for selecting possible course patterns with less conflict, said conflict being defined as a phenomenon that one vehicle's course crosses another vehicle's course at a common intersection at substantially the same time, for determining one of the selected possible course patterns as a course pattern, said course pattern course settings to be taken by the vehicles located within said area to avoid conflict, and for extracting a component indicating a course to be taken by said vehicle carrying said vehicle apparatus, wherein said position detection apparatus and said destination detection apparatus receive information from other vehicles-under-control via a vehicle—vehicle communication channel, and derive the present positions and destinations of at least some of the vehicles located within said area based on the information from other vehicles-under-control.

15. A vehicle apparatus installed in a vehicle and used in a vehicle traffic control system, comprising:

a position detection apparatus for detecting a present position of said vehicle carrying said vehicle apparatus, said vehicle located within an area in which a plurality of vehicles travel along roads and/or tracks intersecting at various locations;

a destination detection apparatus for detecting a destination of said vehicle carrying said vehicle apparatus, through input by said vehicle's passenger or through estimation based on movement of said vehicle;

a course calculation apparatus for calculating possible courses of said vehicle carrying said vehicle apparatus, on the basis of detected present position and destination of said vehicle and speeds to be adopted on respective roads and/or tracks; and a course determination apparatus for transmitting said possible courses calculated by said course calculation apparatus to a control station covering said area, via a controller-vehicle communication channel for connecting said vehicle and said control station, and receiving from said control station via said controller-vehicle communication channel, as a course pattern or its component, information indicating a possible course pattern or component thereof with less conflict relating to said vehicle carrying said vehicle apparatus, said conflict being defined as a phenomenon that one vehicle's course crosses another vehicle's course at an identical intersection at substantially the same time, and said course pattern indicating course settings to be taken by vehicles located within said area.

16. A vehicle apparatus installed in a vehicle and used in a vehicle traffic control system, comprising:

a position detection apparatus for detecting a present position of said vehicle carrying said vehicle apparatus, said vehicle located within an area in which a plurality of vehicles travel along roads and/or tracks intersecting at various locations;

a destination detection apparatus for detecting a destination of said vehicle carrying said vehicle apparatus, through input by said vehicle's passenger or through estimation based on movement of said vehicle; and a course determination apparatus for transmitting a detected present position and a destination of said vehicle carrying said vehicle apparatus to a control station covering said area via a controller-vehicle communication channel connecting said vehicle and said control station, and receiving from said control station via said controller-vehicle communication channel, as a course pattern or its component, information indicating a possible course pattern or component thereof with less conflict relating to said vehicle carrying said vehicle apparatus, said conflict being defined as a phenomenon that one vehicle's course crosses another vehicle's course at an identical intersection at substantially the same time, and said course pattern indicating course settings to be taken by the vehicles located within said area.

17. A controller set for use as a control station in a vehicle traffic control system for controlling a plurality of vehicles located within an area in which a plurality of roads and/or tracks intersect at various locations, comprising:

a position detection apparatus for detecting present positions of vehicles, including a vehicle-under-control, using devices installed on the vehicles or provided externally of the vehicles, said vehicle-under-control being a vehicle yielding to a determined course pattern and located within said area;

a destination detection apparatus for detecting destinations of vehicles, including said vehicle-under-control, through reception from the vehicle-under-control via a vehicle-controller communication channel connecting said vehicle-under-control and said control station, or through estimation based on movements of said vehicles; and a course determination apparatus for transmitting information indicating detected present positions and destinations to said vehicle-under-control via said vehicle-controller communication channel, wherein said vehicle-under-control determines a course pattern or its component relating to the vehicle-under-control on the basis of the information from said control station such that a course of the vehicle-under-control does not cross another vehicle's course at an identical intersection at substantially the same time.

18. A controller set for use as a control station in a vehicle traffic control system for controlling a plurality of vehicles located within an area in which a plurality of roads and/or tracks intersect at various locations, comprising:

a position detection apparatus for detecting present positions of vehicles, including a vehicle-under-control, using devices installed on the vehicles or provided externally of the vehicles, said vehicle-under-control being a vehicle yielding to a determined course pattern and located within said area;

a destination detection apparatus for detecting destinations of vehicles, including said vehicle-under-control, through reception from the vehicle-under-control via a vehicle-controller communication channel connecting said vehicle-under-control and said control station, or through estimation based on movements of said vehicles;

a course calculation apparatus for calculating possible courses of vehicles, including said vehicle-under-control, on the basis of detected present positions and destinations of the vehicles and speeds to be adopted on respective roads and/or tracks; and a course determination apparatus for transmitting information indicating said possible courses calculated by said course calculation apparatus to said vehicle-under-control via said vehicle-controller communication channel, wherein said vehicle-under-control determines a course pattern or its component relating to the vehicle-under-control on the basis of the information from said control station such that a course of the vehicle-under-control does not cross another vehicle's course at an identical intersection at substantially the same time.

* * * * *